US007533952B2

(12) United States Patent
Otokita

(10) Patent No.: US 7,533,952 B2
(45) Date of Patent: May 19, 2009

(54) PRINTING METHOD, PRINTING APPARATUS, AND COMPUTER-READABLE MEDIUM

(75) Inventor: Kenji Otokita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 174 days.

(21) Appl. No.: 11/236,606

(22) Filed: Sep. 28, 2005

(65) Prior Publication Data

US 2006/0082610 A1 Apr. 20, 2006

(30) Foreign Application Priority Data

Sep. 28, 2004 (JP) ..... 2004-282637

(51) Int. Cl.
*B41J 29/38* (2006.01)

(52) U.S. Cl. ..... 347/14; 347/16; 347/19

(58) Field of Classification Search ..... 347/14, 347/16, 5, 9, 19, 12, 13
See application file for complete search history.

(56) References Cited

U.S. PATENT DOCUMENTS 6,474,765 B2 * 11/2002 Beauchamp ..... 347/14

FOREIGN PATENT DOCUMENTS

JP 3096490 U 7/2003

* cited by examiner

*Primary Examiner*—Lam S Nguyen
(74) *Attorney, Agent, or Firm*—Sughrue Mion, PLLC

(57) ABSTRACT

Degradation in the image quality of a print image is suppressed even in a case where a head is installed at an angle with respect to its movement direction. A printing method includes the following steps: a step of performing a carrying operation for carrying a medium; a step of performing, during an interim of the carrying operation, a moving-and-ejecting operation for ejecting ink at a same timing from a plurality of nozzles onto the medium while moving the nozzles relative to the medium; and a step of changing, every time the carrying operation is performed, the timing at which the ink is ejected from the plurality of nozzles in accordance with a carry amount of the carrying operation that has actually been performed.

11 Claims, 27 Drawing Sheets

| resolution | print mode | carry amount (dpi) | inch | amount of change |
|---|---|---|---|---|
| 720 × 180 (dpi) | band | 180／180 (dpi) | 1 | α1 |
| 720 × 360 (dpi) | interlaced | 179／360 (dpi) | 1／2 | α2 |
| 720 × 720 (dpi) | interlaced | 179／720 (dpi) | 1／4 | α3 |
| 1440 × 720 (dpi) | overlap | 89／720 (dpi) | 1／9 | α4 |
| 1440 × 1440 (dpi) | overlap | 89／1440 (dpi) | 1／16 | α5 |

Fig.23

PRINTING METHOD, PRINTING APPARATUS, AND COMPUTER-READABLE MEDIUM

CROSS-REFERENCE TO RELATED APPLICATIONS

The present application claims priority upon Japanese Patent Application No. 2004-282637 filed on Sep. 28, 2004, which is herein incorporated by reference.

BACKGROUND OF THE INVENTION

1. Field of the Invention

The present invention relates to printing methods, printing apparatuses, and computer-readable media.

2. Description of the Related Art

Inkjet printers are known as printing apparatuses for carrying out printing on media such as various types of paper, films, and cloths. Inkjet printers print images by forming dots on a medium by ejecting ink onto the medium. Such inkjet printers are provided with heads that move relatively in the direction perpendicular to the carrying direction of a medium. The heads are provided with a plurality of nozzles that eject ink onto a medium. Each of the plurality of nozzles ejects ink onto a medium when the head moves relative to the medium. Accordingly, dots are formed on the medium and an image is printed. Inkjet printers perform a printing process by performing in alternation such an ink ejecting operation and a carrying operation for carrying a medium in a predetermined direction (see Publication of Japanese Registered Utility Model No. 3096490).

However, in such printing apparatuses, there are cases in which a head is installed at an angle with respect to its movement direction. This is caused by, for example, an error in manufacturing or a head installation in the case of a removable head. When a head is installed at an angle in this manner, there is a trouble that the positions of dots formed with ink ejected from the nozzles are significantly shifted. When the positions of dots are shifted in this manner, there is a risk that the positions of dots previously formed on a medium and those of dots newly formed are significantly shifted from each other, and thus an image to be printed cannot be constituted properly, resulting in a degraded image quality.

SUMMARY OF THE INVENTION

The present invention was arrived at in view of such problems, and it is an object thereof to suppress degradation in the image quality of a print image even in a case where a head is installed at an angle with respect to its movement direction.

A primary aspect of the present invention is a printing method such as the following.

A printing method includes:

a step of performing a carrying operation for carrying a medium;

a step of performing, during an interim of the carrying operation, a moving-and-ejecting operation for ejecting ink at a same timing from a plurality of nozzles onto the medium while moving the nozzles relative to the medium; and a step of changing, every time the carrying operation is performed, the timing at which the ink is ejected from the plurality of nozzles in accordance with a carry amount of the carrying operation that has actually been performed.

Furthermore, another primary aspect of the present invention is a printing apparatus such as the following.

A printing apparatus includes:

a carry mechanism capable of performing a carrying operation of carrying a medium with at least two different carry amounts;

a plurality of nozzles that perform a moving-and-ejecting operation of ejecting ink onto the medium while moving relative to the medium during an interim of the carrying operation;

a signal outputting section that outputs a signal serving as a reference for causing the ink to be ejected at a same timing from the plurality of nozzles; and a controller that changes a timing at which the signal is output from the signal outputting section, every time the carrying operation is performed, in accordance with a carry amount of the carrying operation that has actually been performed.

Furthermore, another primary aspect of the present invention is a computer-readable medium such as the following.

A computer-readable medium for causing a printing apparatus to operate, includes:

a code for performing a carrying operation of carrying a medium with a carry mechanism;

a code for performing, during an interim of the carrying operation, a moving-and-ejecting operation of ejecting ink at a same timing from a plurality of nozzles onto the medium while moving the nozzles relative to the medium; and a code for changing, every time the carrying operation is performed, the timing at which the ink is ejected from the plurality of nozzles in accordance with a carry amount of the carrying operation that has actually been performed.

BRIEF DESCRIPTION OF THE DRAWINGS

For a more complete understanding of the present invention and the advantages thereof, reference is now made to the following description taken in conjunction with the accompanying drawings.

FIG. 23 is a diagram illustrating an example of a table.

DETAILED DESCRIPTION OF PREFERRED EMBODIMENTS

Figure 1:
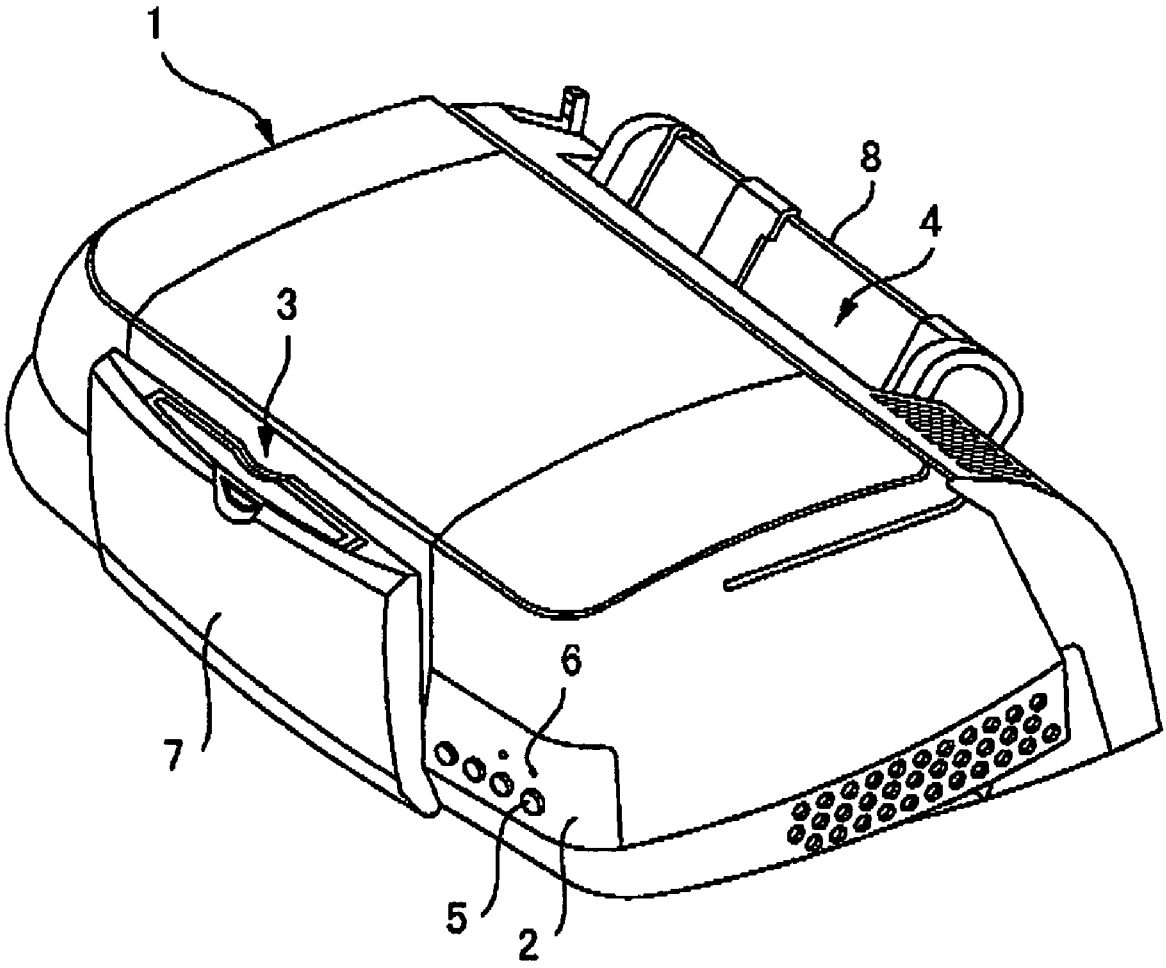
FIG. 1 is a perspective view of a printing apparatus according to an embodiment.

At least the following matters will be made clear by the explanation in the present specification and the description of the accompanying drawings.

A printing method includes:

a step of performing a carrying operation for carrying a medium;

a step of performing, during an interim of the carrying operation, a moving-and-ejecting operation for ejecting ink at a same timing from a plurality of nozzles onto the medium while moving the nozzles relative to the medium; and a step of changing, every time the carrying operation is performed, the timing at which the ink is ejected from the plurality of nozzles in accordance with a carry amount of the carrying operation that has actually been performed.

With this printing method, it is possible to change the timing at which ink is ejected from the plurality of nozzles, every time the carrying operation is performed, in accordance with the carry amount of the carrying operation that has been actually performed, and thus it is possible to adjust the positions of dots formed with ink ejected from the nozzles. Accordingly, since it is possible to adjust the positions at which dots are formed, every time the carrying operation is performed, it is possible to prevent the quality of an image to be printed from being significantly damaged even in a case where dots formed on a medium are formed at an angle. Thus, it is possible to improve the image quality of a print image.

In this printing method, it is preferable that the plurality of nozzles are arranged in a predetermined direction.

When the plurality of nozzles are arranged in a predetermined direction in this manner, it is possible to sufficiently suppress degradation in the image quality of a print image.

In this printing method, it is preferable that the predetermined direction in which the plurality of nozzles are arranged intersects with a direction in which the medium is carried.

When the direction in which the plurality of nozzles are arranged intersects with the direction in which the medium is carried in this manner, it is possible to improve the image quality of a print image by adjusting the positions at which dots are formed.

In this printing method, it is preferable that the carry amount of the carrying operation varies in accordance with a print mode.

Even in a case where the carry amount of the carrying operation varies in accordance with a print mode in this manner, it is possible to prevent the image quality of a print image from being degraded, by changing the timing at which ink is ejected from the plurality of nozzles in accordance with the carry amount of the carrying operation, so as to adjust the positions at which dots are formed.

In this printing method, it is preferable that the carry amount of the carrying operation varies in accordance with a resolution of an image to be printed.

Even in a case where the carry amount of the carrying operation varies in accordance with the resolution of an image to be printed in this manner, it is possible to prevent the image quality of a print image from being degraded, by changing the timing at which ink is ejected from the plurality of nozzles, so as to adjust the positions at which dots are formed.

In this printing method, it is preferable that positions of dots formed on the medium with ink ejected from the plurality of nozzles are gradually shifted in one direction every time the carrying operation is performed.

When the positions at which dots are formed are gradually shifted in one direction in this manner every time the carrying operation is performed, it is possible to prevent the image quality of a print image from being degraded.

In this printing method, it is preferable that an amount of shifting of the positions of the dots, which are formed on the medium with the ink ejected from the plurality of nozzles, varies in accordance with the carry amount of the carrying operation that has been performed.

By varying the amount of shifting of the positions at which dots are formed in accordance with the carry amount of the carrying operation in this manner, it is possible to prevent the image quality of a print image from being degraded by arranging dots at appropriate positions.

In this printing method, it is preferable that an amount of change in the timing is calculated by a calculating section.

When an amount of change in the timing is calculated by a calculating section in this manner, it is possible to easily obtain the amount of change in the timing.

In this printing method, it is preferable that an amount of change in the timing is calculated based on the carry amount of the carrying operation that has been performed and predetermined correction information.

When calculating based on a carry amount of the carrying operation and predetermined correction information in this manner, it is possible to easily calculate the amount of change in the timing.

In this printing method, it is preferable that the timing is changed according to a table in which the carry amount of the carrying operation that is performed is associated with an amount of change in the timing.

When this table is used, it is possible to easily change the timing.

It is preferable that this printing method further includes a step of printing a detection pattern for detecting an appropriate amount of change in the timing.

When this step is provided, it is possible to easily detect an appropriate amount of change in the timing by printing the detection pattern.

Furthermore, it is also possible to achieve a printing apparatus such as the following.

A printing apparatus includes:

a carry mechanism capable of performing a carrying operation of carrying a medium with at least two different carry amounts;

a plurality of nozzles that perform a moving-and-ejecting operation of ejecting ink onto the medium while moving relative to the medium during an interim of the carrying operation;

a signal outputting section that outputs a signal serving as a reference for causing the ink to be ejected at a same timing from the plurality of nozzles; and a controller that changes a timing at which the signal is output from the signal outputting section, every time the carrying operation is performed, in accordance with a carry amount of the carrying operation that has actually been performed.

With this printing apparatus, it is possible to change the timing at which the signal is output from the signal outputting section, every time the carrying operation is performed, in accordance with a carry amount of the carrying operation that has been actually performed, and thus it is possible to adjust the positions of dots formed with ink ejected from the nozzles. Accordingly, since it is possible to adjust the positions at which dots are formed, every time the carrying operation is performed, it is possible to prevent the quality of an image to be printed from being significantly damaged even in a case where dots formed on a medium are formed at an angle. Thus, it is possible to improve the image quality of a print image.

Furthermore, it is also possible to achieve a computer-readable medium such as the following.

A computer-readable medium for causing a printing apparatus to operate, includes:

a code for performing a carrying operation of carrying a medium with a carry mechanism;

a code for performing, during an interim of the carrying operation, a moving-and-ejecting operation of ejecting ink at a same timing from a plurality of nozzles onto the medium while moving the nozzles relative to the medium; and a code for changing, every time the carrying operation is performed, the timing at which the ink is ejected from the plurality of nozzles in accordance with a carry amount of the carrying operation that has actually been performed.

With this computer-readable medium, it is impossible to change the timing at which ink is ejected from the plurality of nozzles, every time the carrying operation is performed, in accordance with the carry amount of the carrying operation that has been actually performed, and thus it is possible to adjust the positions of dots formed with ink ejected from the nozzles. Accordingly, since it is possible to adjust the positions at which dots are formed, every time the carrying operation is performed, it is possible to prevent the quality of an image to be printed from being significantly damaged even in a case where dots formed on a medium are formed at an angle. Thus, it is possible to improve the image quality of a print image.

Outline of Printing Apparatus

Figure 2:
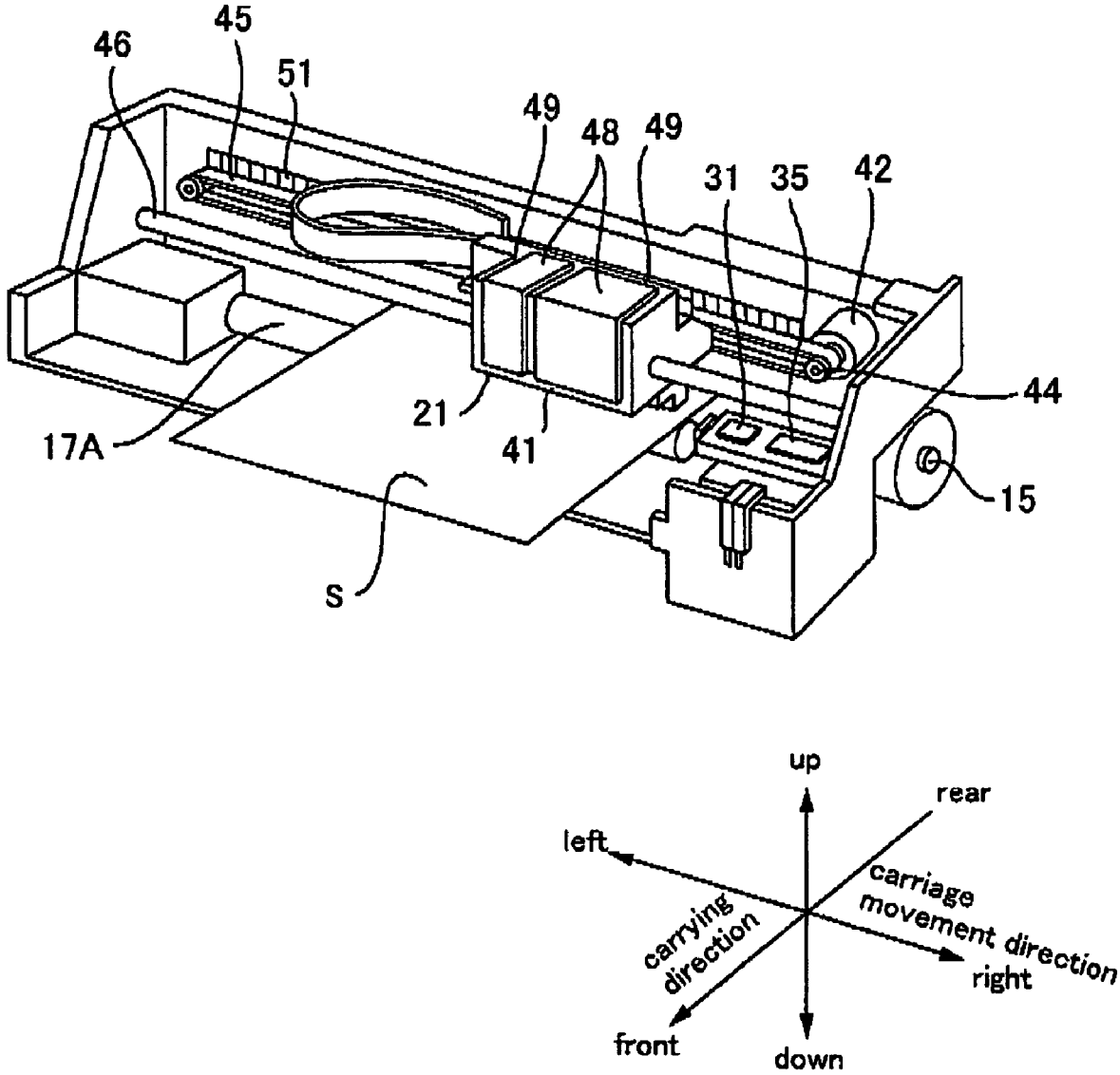
FIG. 2 is a perspective view illustrating the internal configuration of the printing apparatus.
Figure 3:
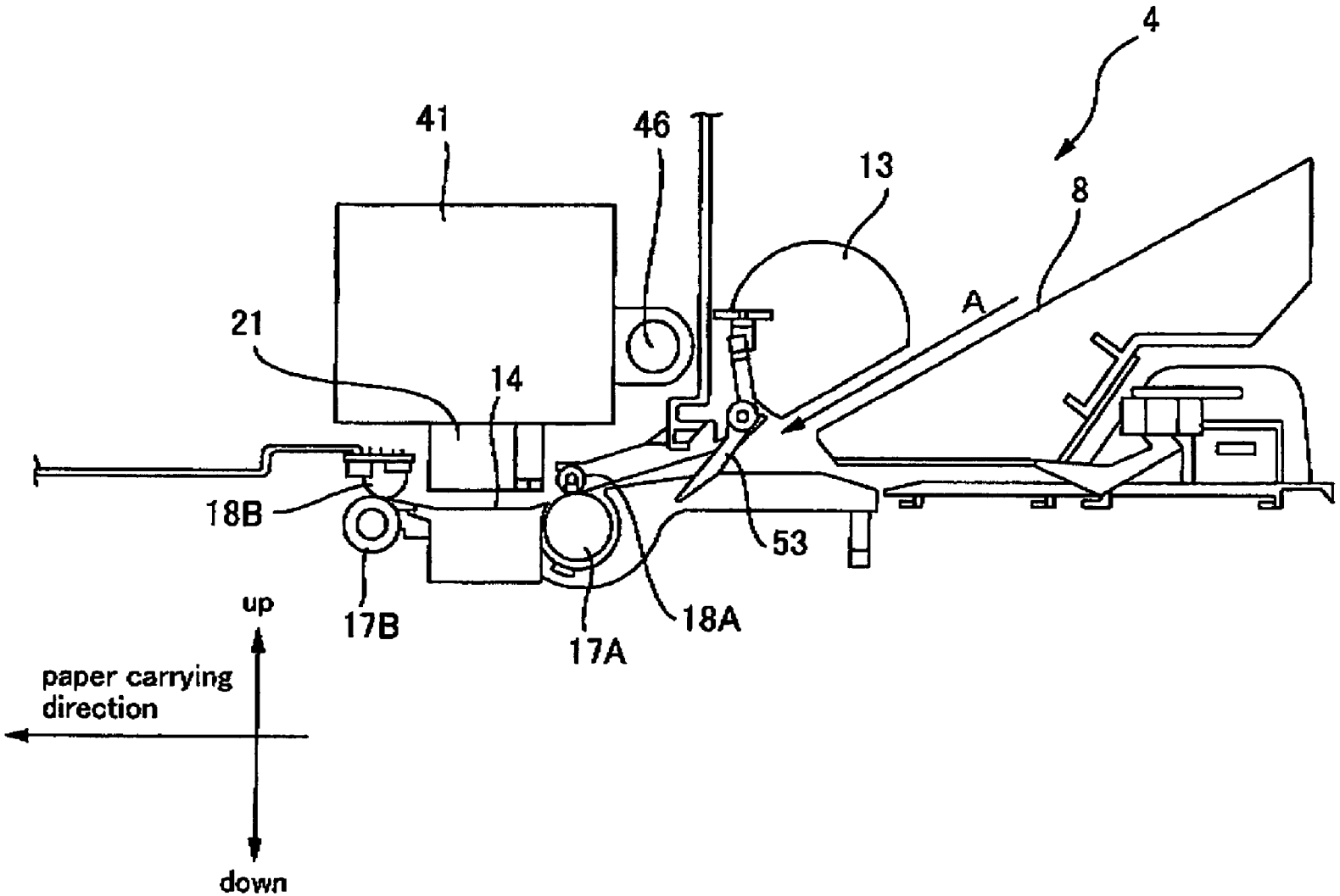
FIG. 3 is a cross-sectional view showing a carrying section of the printing apparatus.
Figure 4:
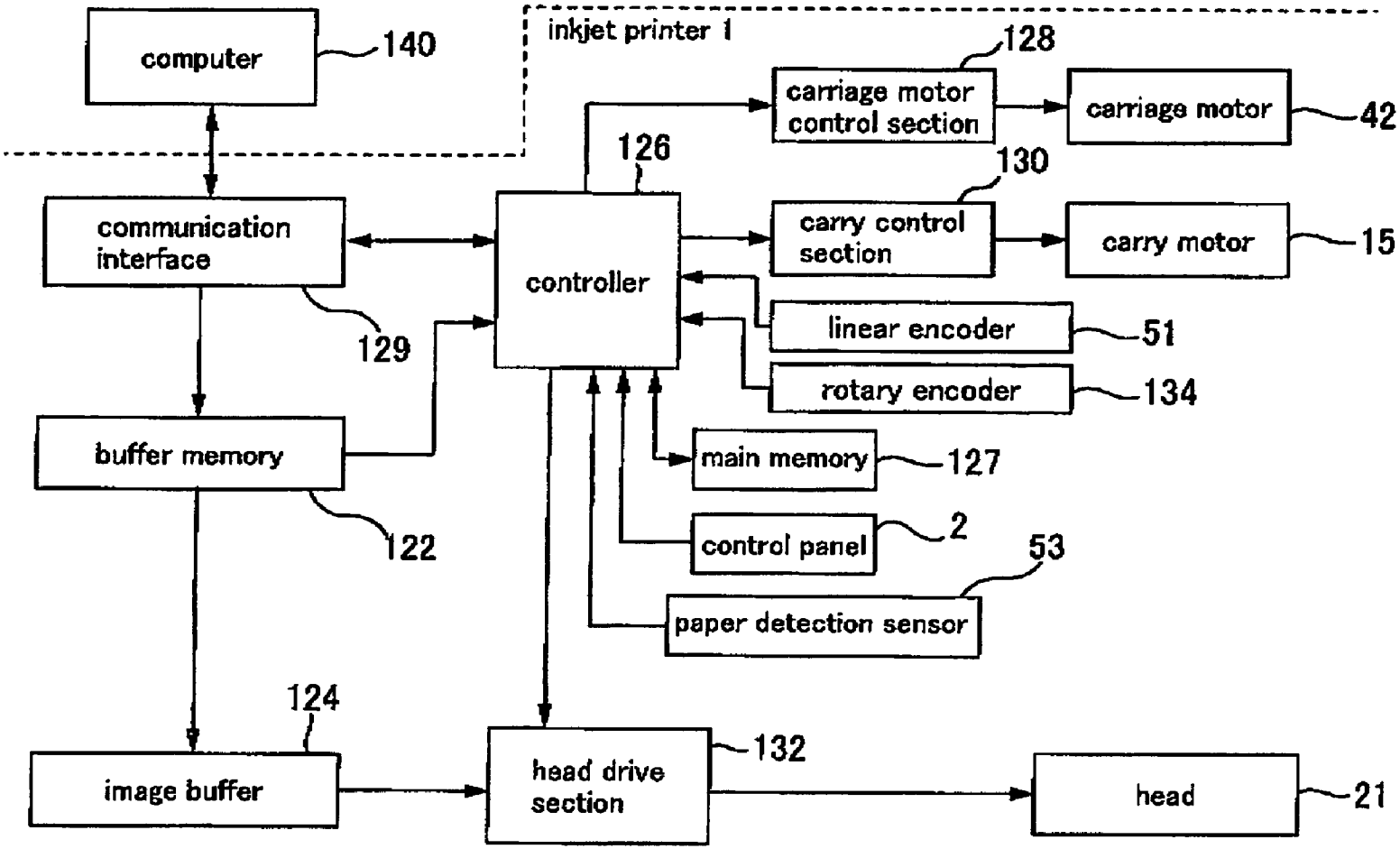
FIG. 4 is a block diagram showing the system configuration of the printing apparatus.

A printing apparatus according to an embodiment of the present invention is described with an inkjet printer serving as an example. FIGS. 1 to 4 show an inkjet printer 1. FIG. 1 shows the appearance of the inkjet printer 1. FIG. 2 shows the internal configuration of the inkjet printer 1. FIG. 3 shows the configuration of a carrying section of the inkjet printer 1. FIG. 4 shows the system configuration of the inkjet printer 1.

As shown in FIG. 1, the inkjet printer 1 is provided with a structure in which a medium such as print paper that is supplied from the rear face is discharged from the front face. The front face portion is provided with a control panel 2 and a paper discharge section 3, and the rear face portion is provided with a paper supply section 4. The control panel 2 is provided with various types of control buttons 5 and display lamps 6. Furthermore, the paper discharge section 3 is provided with a paper discharge tray 7 that blocks the paper discharge opening when the inkjet printer is not used. The paper supply section 4 is provided with a paper supply tray 8 for holding a medium such as cut paper.

As shown in FIG. 2, the internal portion of the inkjet printer 1 is provided with a carriage 41. The carriage 41 is disposed such that it can move relatively in the left-to-right direction. A carriage motor 42, a pulley 44, a timing belt 45, and a guide rail 46 are arranged in the vicinity of the carriage 41. The carriage motor 42 is constituted by a DC motor or the like and functions as a driving force for moving the carriage 41 relatively in the left-to-right direction (hereinafter, also referred to as "carriage movement direction"). The timing belt 45 is connected via the pulley 44 to the carriage motor 42, and a part of it is also connected to the carriage 41, such that the carriage 41 is moved relatively in the carriage movement direction (left-to-right direction) with the rotational force of the carriage motor 42. The guide rail 46 guides the carriage 41 in the carriage movement direction (left-to-right direction).

In addition to the above, a linear encoder 51 for detecting the position of the carriage 41, a carry roller 17A for carrying a medium S in the direction (front-to-rear direction in the drawing, and hereinafter, also referred to as "carrying direction") that intersects with the movement direction of the carriage 41, and a carry motor 15 for rotatively driving the carry roller 17A are arranged in the vicinity of the carriage 41.

On the other hand, the carriage 41 is provided with ink cartridges 48 that contain various types of ink and a head 21 that carries out printing on the medium S. The ink cartridges 48 contain ink of various colors such as yellow (Y), magenta (M), cyan (C), and black (K), and are mounted in a cartridge mounting section 49 provided in the carriage 41 in a removable manner. Furthermore, in this embodiment, the head 21 carries out printing by ejecting ink onto the medium S. For this reason, the head 21 is provided with a large number of nozzles for ejecting ink.

In addition to the above, the internal portion of the inkjet printer 1 is provided with, for example, a pump device 31 for pumping ink from the nozzles such that clogging in the nozzles of the head 21 is eliminated, and a capping device 35 for capping the nozzles of the head 21 when printing is not being carried out (when being on standby, for example) such that clogging in the nozzles of the head 21 is prevented.

The following is a description concerning a carrying section of the inkjet printer 1. As shown in FIG. 3, the carrying section is provided with a paper supply roller 13, a paper detection sensor 53, the carry roller 17A, a paper discharge roller 17B, a platen 14, and free rollers 18A and 18B.

The medium S to be printed is set at the paper supply tray 8. The medium S that has been set at the paper supply tray 8 is carried along the arrow A in the drawing by the paper supply roller 13, which has a substantially D-shaped cross-section, and is sent into the internal portion of the inkjet printer 1. The medium S that has been sent into the internal portion of the inkjet printer 1 is brought into contact with the paper detection sensor 53. This paper detection sensor 53 is positioned between the paper supply roller 13 and the carry roller 17A, so that it detects the medium S that has been supplied by the paper supply roller 13.

The medium S that has been detected by the paper detection sensor 53 is carried by the carry roller 17A one by one to the platen 14 on which printing is carried out. The free roller 18A is disposed at the position opposed to the carry roller 17A. The medium S is placed between the free roller 18A and the carry roller 17A such that the medium S is smoothly carried.

The medium S that has been sent onto the platen 14 is one by one printed with ink ejected from the head 21. The platen 14 is disposed so as to be opposed to the head 21 and supports the medium S to be printed from the below.

The medium S on which printing has been carried out is discharged by the paper discharge roller 17B one by one to the outside of the printer. The paper discharge roller 17B is driven in synchronization with the carry motor 15, and discharges the medium S to the outside of the printer by holding the medium S between the paper discharge roller 17B and the free roller 18B that is disposed so as to be opposed to this paper discharge roller 17B.

<System Configuration>

The following is a description concerning the system configuration of the inkjet printer 1. As shown in FIG. 4, the inkjet printer 1 is provided with a buffer memory 122, an image buffer 124, a controller 126 a main memory 127, a communication interface 129, a carriage motor control section 128, a carry control section 130, and a head drive section 132.

The communication interface 129 is used by the inkjet printer 1 to exchange data with an external computer 140 such as a personal computer. The communication interface 129 is connected to the external computer 140 such that wired or wireless communications are possible, and receives various types of data such as print data transmitted from the computer 140.

The various types of data such as print data received by the communication interface 129 is temporarily stored in the buffer memory 122. Furthermore, the print data stored in the buffer memory is sequentially stored in the image buffer 124. The print data stored in the image buffer 124 is sequentially sent to the head drive section 132. Furthermore, the main memory 127 is constituted by a ROM, a RAM, or an EEPROM for example. Various programs for controlling the inkjet printer 1 and various types of setting data, for example, is stored in the main memory 127.

The controller 126 reads out a control program and various types of setting data from the main memory 127 and performs overall control of the inkjet printer 1 in accordance with the control program and the various types of setting data. Furthermore, detection signals from various sensors such as a rotary encoder 134, the linear encoder 51, and the paper detection sensor 53 are input to the controller 126.

When various types of data such as print data that has been sent from the external computer 140 is received by the communication interface 129 and is stored in the buffer memory 122, the controller 126 reads out necessary information from among the stored data from the buffer memory 122. Based on the information that is read out, the controller 126 controls each of the carriage motor control section 128, the carry control section 130, and the head drive section 132, for example, in accordance with a control program while referencing output from the linear encoder 51 and the rotary encoder 134.

The carriage motor control section 128 controls the drive such as the rotation direction, the rotation number, and the torque of the carriage motor 42 in accordance with instructions from the controller 126. The carry control section 130 controls the drive of, for example, the carry motor 15 for rotatively driving the carry roller 17A in accordance with instructions from the controller 126.

The head drive section 132 controls the drive of the color nozzles provided at the head 21 in accordance with instructions from the controller 126 and based on print data stored in the image buffer 124.

<Head>

Figure 5:
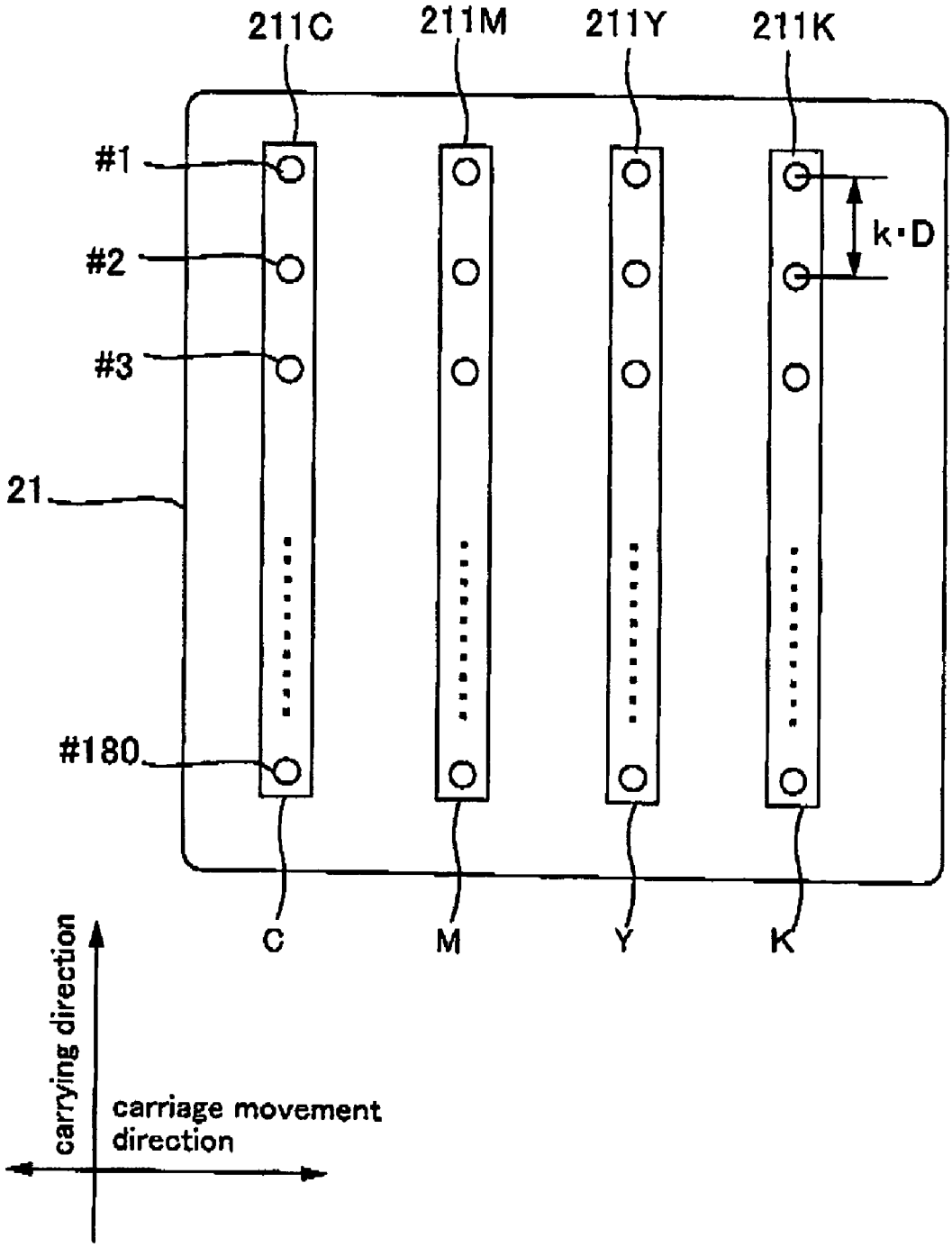
FIG. 5 is an explanatory diagram showing the arrangement of nozzles of a head.

FIG. 5 is a diagram showing the arrangement of the ink nozzles provided on the bottom surface portion of the head 21. As shown in this drawing, the bottom face portion of the head 21 is provided with nozzle rows constituted by a plurality of nozzles #1 to #180 for each of the colors yellow (Y), magenta (M), cyan (C), and black (K), that is, a cyan nozzle row 211C, a magenta nozzle row 211M, a yellow nozzle row 211Y, and a black nozzle row 211K.

The nozzles #1 to #180 in each of the nozzle rows 211C, 211M, 211Y, and 211K are arranged in a straight line in a predetermined direction. In this embodiment, when the head is normally installed, the nozzles #1 to #180 in each of the nozzle rows 211C, 211M, 211Y, and 211K are arranged in the carrying direction of the medium S. The nozzle rows 211C, 211M, 211Y, and 211K are arranged in parallel with spaces therebetween in the movement direction (scanning direction) of the head 21. The nozzles #1 to #180 are provided with piezo elements (not shown) as drive elements for ejecting ink droplets.

When a voltage of a predetermined duration is applied between electrodes provided at both ends of the piezo elements, the piezo elements expand for the duration of voltage application and deform a lateral wall of the ink channel. Accordingly, the volume of the ink channel is constricted according to the elongation of the piezo element, and ink corresponding to this amount of constriction becomes an ink droplet, which is ejected from the corresponding nozzle #1 to #180 of the color nozzle rows 211C, 211M, 211Y, and 211K.

Linear Encoder

<Configuration of Encoder>

Figure 6:
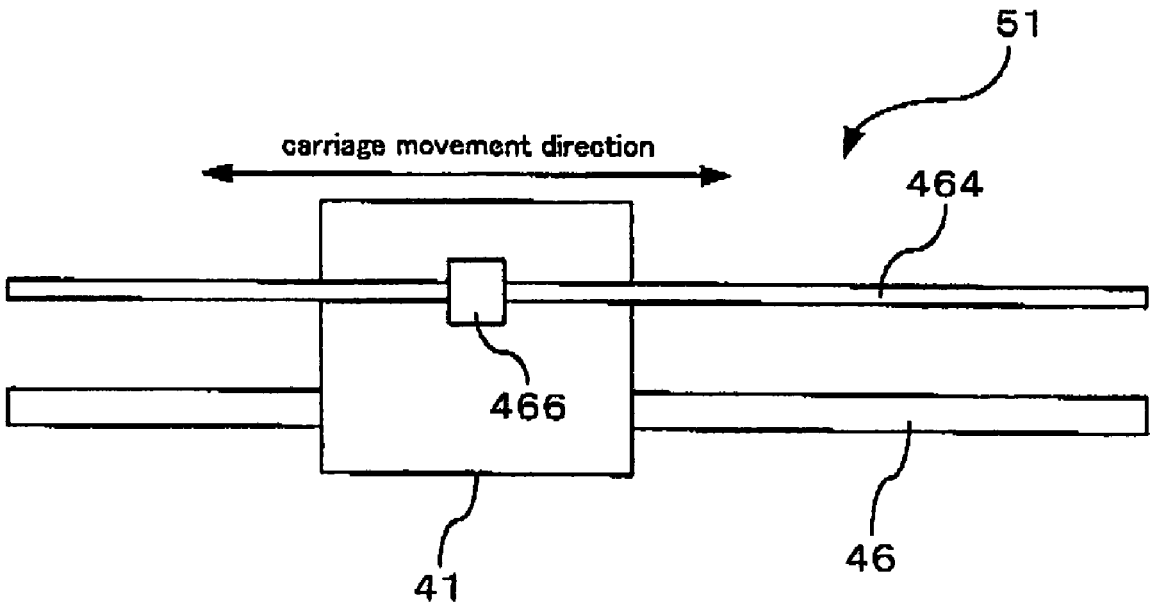
FIG. 6 is a view schematically illustrating the configuration of a linear encoder.

FIG. 6 schematically shows the configuration of the linear encoder 51. The linear encoder 51 is provided with a linear encoder code plate 464 and a detecting section 466. As shown in FIG. 2, the linear encoder code plate 464 is attached on the side of the frame inside the inkjet printer 1. On the other hand, the detecting section 466 is attached to the side of the carriage 41. When the carriage 41 moves along the guide rail 46, the detecting section 466 moves relatively along the linear encoder code plate 464. Accordingly, the detecting section 466 detects the amount that the carriage 41 has moved.

<Configuration of Detecting Section>

Figure 7:
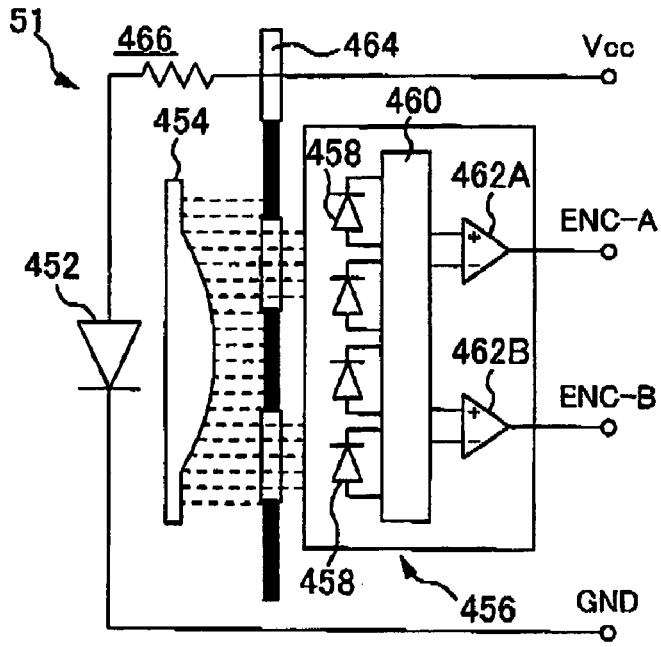
FIG. 7 is a diagram schematically illustrating the configuration of a detecting section of the linear encoder.

FIG. 7 schematically shows the configuration of the detecting section 466. The detecting section 466 is provided with a light-emitting diode 452, a collimating lens 454, and a detection processing section 456. The detection processing section 456 has a plurality of (for instance, four) photodiodes 458, a signal processing circuit 460, and for example two comparators 462A and 462B.

The light-emitting diode 452 emits light when a voltage Vcc is applied via resistors to both ends of the light-emitting diode 452. This light is condensed into parallel light by the collimating lens 454 and passes through the linear encoder code plate 464. The linear encoder code plate 464 is provided with slits at a predetermined spacing (for example, 1/180 inch (one inch=2.54 cm)).

The parallel light that has passed through the linear encoder code plate 464 then passes through stationary slits (not shown) and is incident onto the photodiodes 458, where it is converted into electrical signals. The electrical signals that are output from the four photodiodes 458 are subjected to signal processing in the signal processing circuit 460, and the signals that are output from the signal processing circuit 460 are compared in the comparators 462A and 462B, and the results of these comparisons are output as pulses. Pulses ENC-A and ENC-B that are output from the comparators 462A and 462B become the output of the linear encoder 51.

<Output Signals>

Figure 8A:
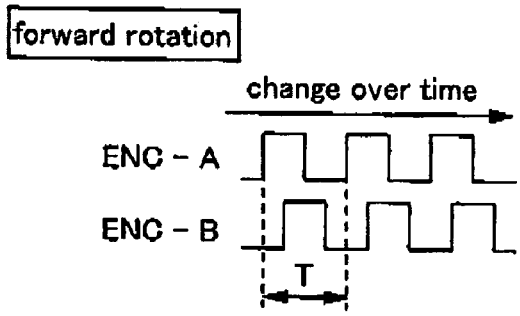
FIG. 8A is a timing chart showing output waveforms of the linear encoder when rotating forward.
Figure 8B:
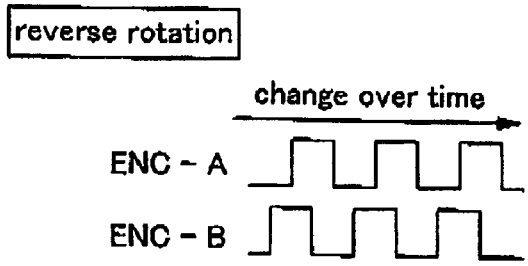
FIG. 8B is a timing chart showing output waveforms of the linear encoder when rotating in reverse.

FIGS. 8A and 8B are timing charts showing waveforms of two output signals of the detecting section 466 when the carriage motor 42 is rotating forward and when it is rotating in reverse. As shown in FIGS. 8A and 8B, the phases of the pulse ENC-A and the pulse ENC-B are shifted by 90 degrees both when the carriage motor 42 is rotating forward and when it is rotating in reverse. When the carriage motor 42 is rotating forward, that is, when the carriage 41 is moving along the guide rail 46, then, as shown in FIG. 8A, the phase of the pulse ENC-A leads the phase of the pulse ENC-B by 90 degrees. On the other hand, when the carriage motor 42 is rotating in reverse, then, as shown in FIG. 8B, the phase of the pulse ENC-A is delayed by 90 degrees with respect to the phase of the pulse ENC-B. A single cycle T of the pulse ENC-A and the pulse ENC-B is equivalent to the time during which the carriage 41 is moved by the slit spacing of the linear encoder code plate 464.

Then, the rising edges of the output pulses ENC-A and ENC-B of the linear encoder 51 are detected, and the number of detected edges is counted. The rotational position of the carriage motor 42 is calculated based on the counted number. With respect to the calculation, when the carriage motor 42 is rotating forward, a "+1" is added for each detected edge, and when it is rotating in reverse, a "−1" is added for each detected edge. The cycle of the pulses ENC-A and ENC-B is equal to the time from when one slit of the linear encoder code plate 464 passes through the detecting section 466 to when the next slit passes through the detecting section 466, and the phases of the pulse ENC-A and the pulse ENC-B are shifted by 90 degrees. Accordingly, a count value of "1" of the calculation corresponds to ¼ of the slit spacing of the linear encoder code plate 464. Therefore, if the counted number is multiplied by ¼ of the slit spacing, then the amount that the carriage from the rotational position corresponding to the count number "0" can be obtained based on this product. The resolution of the linear encoder 51 at this time is ¼ the slit spacing of the linear encoder code plate 464.

Rotary Encoder

The configuration of a rotary encoder is described.

Figure 9:
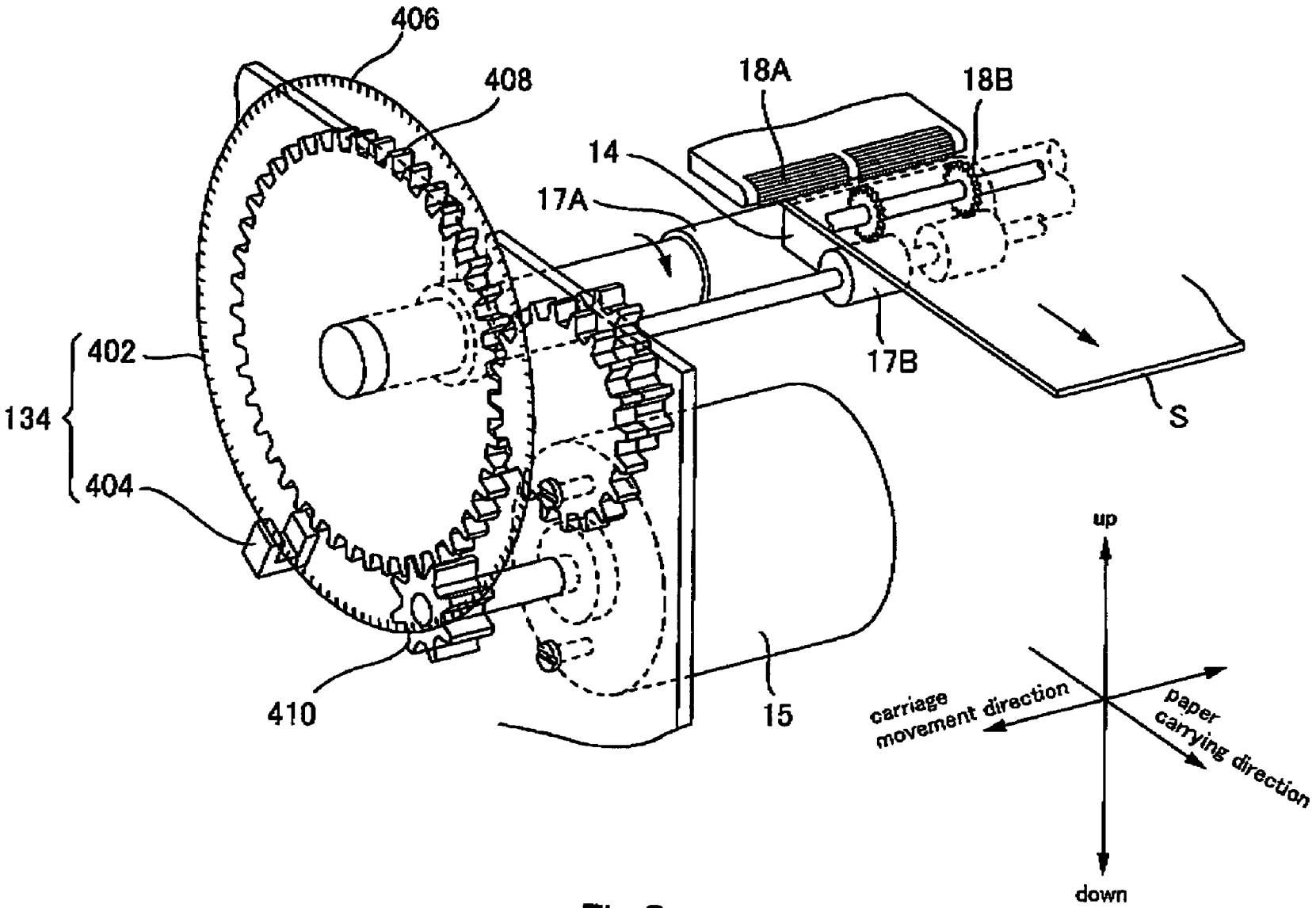
FIG. 9 is a view illustrating the configuration of a rotary encoder.

FIG. 9 is an explanatory diagram illustrating the configuration of the rotary encoder 134. The rotary encoder 134 is provided with a rotary encoder code plate 402 and a detecting section 404 provided adjacent to this rotary encoder code plate 402.

As shown in FIG. 9, the rotary encoder code plate 402 is formed as a disk plate. A large number of small slits 406 are formed at a predetermined spacing at the outer circumferential edge portion of the rotary encoder code plate 402. The rotary encoder code plate 402 is formed integrally adjacent to a large gear 408 provided integrally in the shaft end portion of the carry roller 17A for carrying the medium S. The large gear 408 is connected via a small gear 410 to the paper carry motor 15, and rotates via the small gear 410 with the rotational force of the paper carry motor 15. Accordingly, the carry roller 17A rotates with the rotational force of the paper carry motor 15, and the rotary encoder code plate 402 rotates in synchronization with the large gear 408 and the carry roller 17A.

It should be noted that the detecting section 404 of the rotary encoder 134 has the configuration that is substantially same as the configuration of the detecting section 466 of the linear encoder 51.

Drive Circuit of Head

Figure 10:
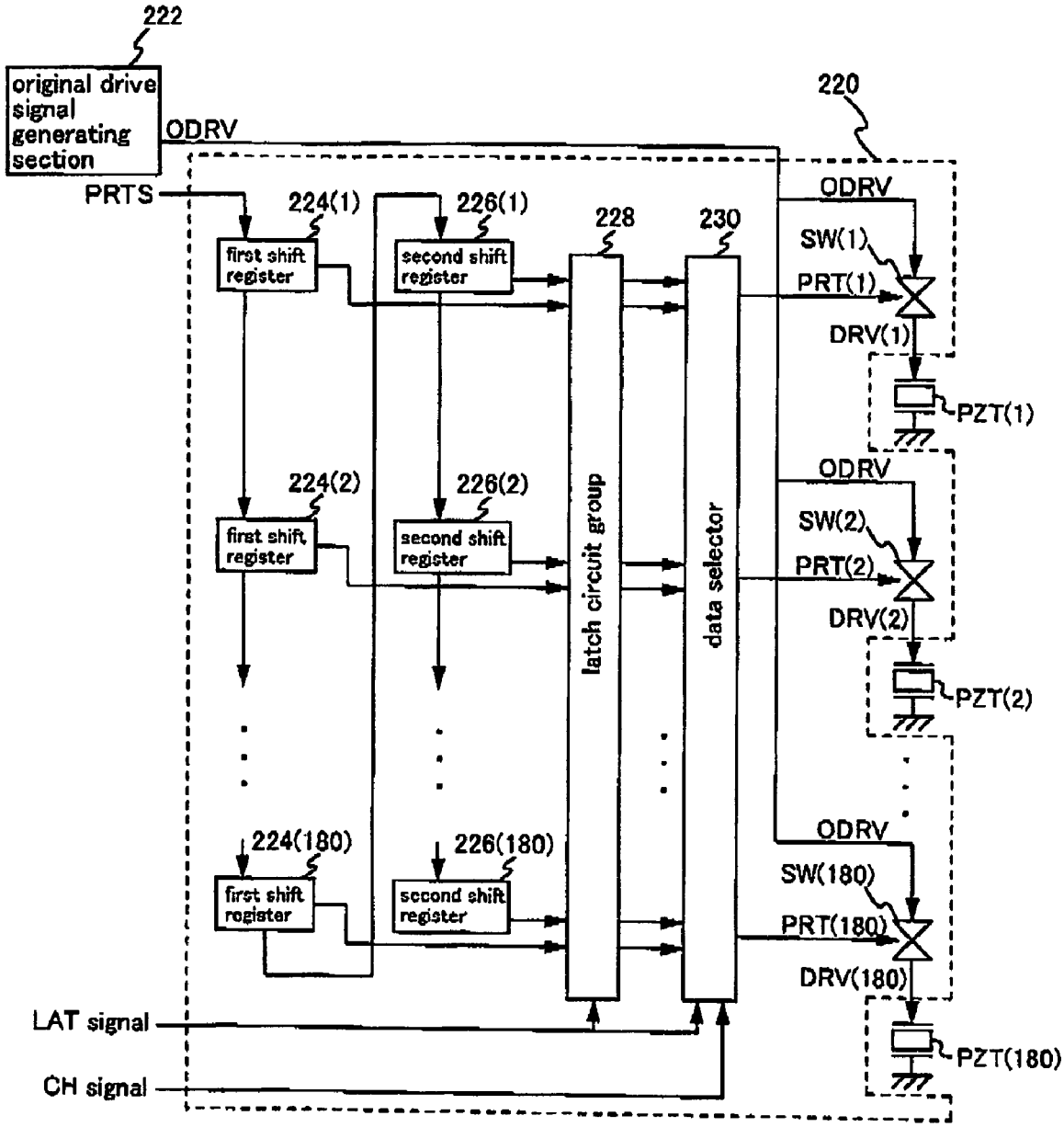
FIG. 10 is a diagram illustrating an example of a drive circuit of the head.
Figure 11:
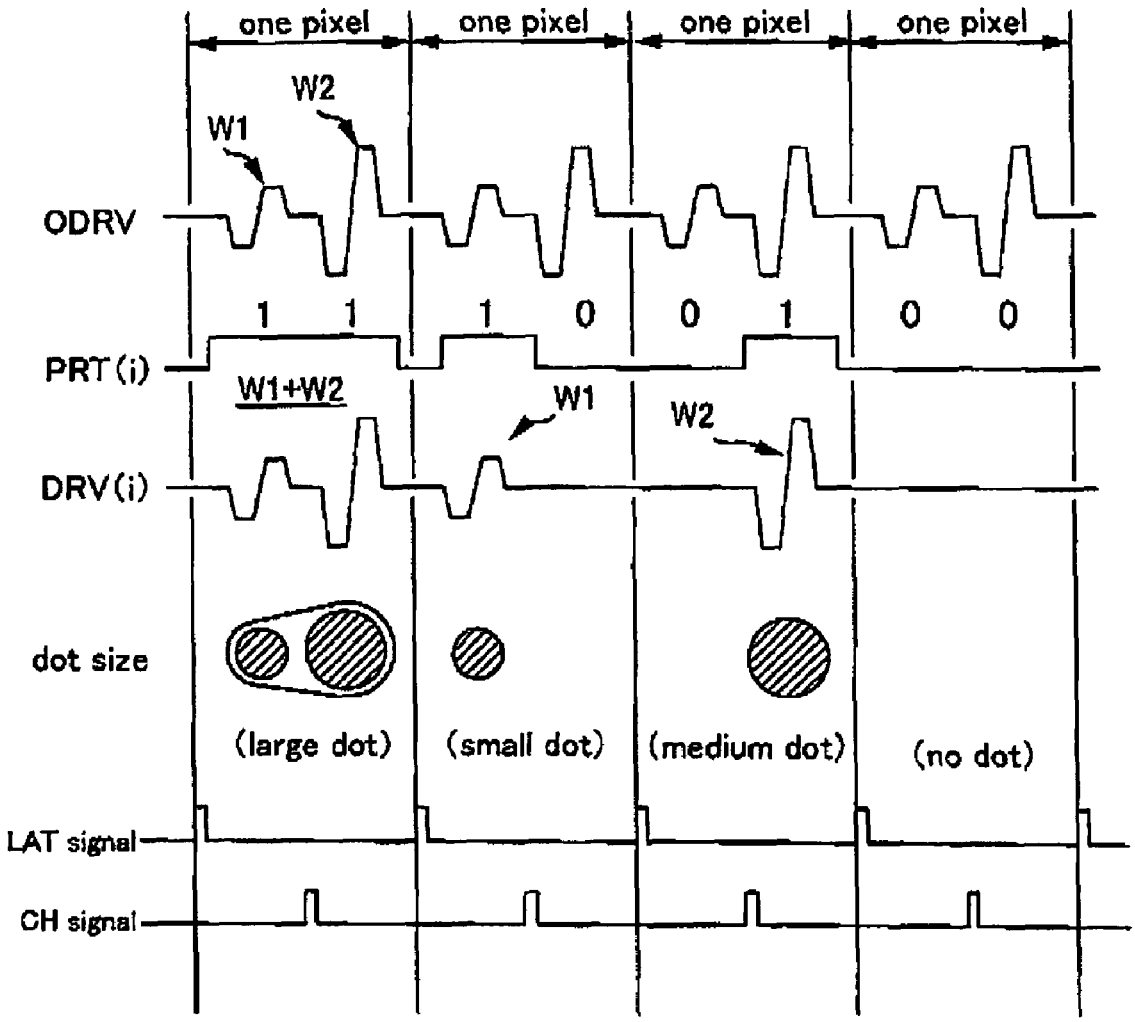
FIG. 11 is a timing chart of signals.

FIG. 10 shows an example of a drive circuit 220 of the head 21. Furthermore, FIG. 11 is a timing chart illustrating the signals of the drive circuit 220.

The drive circuit 220 is provided for letting ink be ejected from the nozzles #1 to #180 provided at the head 21, and drives 180 piezo elements PZT(1) to (180) provided respectively at the nozzles #1 to #180. The piezo elements PZT(1) to (180) are driven based on a print signal PRTS that is input to this drive circuit 220. In FIG. 10, the numbers in parentheses indicated at the end of the signals or components denote the nozzle numbers 1 to 180 corresponding to the signals or components.

In this embodiment, such drive circuit 220 is provided for each of the nozzle rows 211Y, 211M, 211C, and 211K provided at the head 21. More specifically, four nozzle drive circuits 220 are provided respectively at the yellow ink nozzle row 211Y, the magenta ink nozzle row 211M, the cyan ink nozzle row 211C and the black ink nozzle row 211K.

The configuration of the drive circuit 220 is described. As shown in FIG. 10, the drive circuit 220 is provided with an original drive signal generating section 222 for generating an original drive signal ODRV, 180 first shift registers 224(1) to (180), 180 second shift registers 226(1) to (180), a latch circuit group 228, a data selector 230, and 180 switches SW(1) to (180).

The original drive signal generating section 222 generates an original drive signal ODRV that is shared by the nozzles #1 to #180. The original drive signal ODRV is a signal for driving the piezo elements PZT(1) to (180) provided respectively at the nozzles #1 to #180. As shown in FIG. 11, the original drive signal ODRV is a signal that has a plurality of pulses in a main-scanning period for one pixel (within a time during which the carriage 41 passes through the spacing for one pixel), that is, in this embodiment, a first pulse W1 and a second pulse W2. In the original drive signal ODRV, the plurality of pulses (first pulse W1 and second pulse W2) are repeatedly generated at a predetermined cycle. The original drive signal ODRV generated by the original drive signal generating section 222 is output toward the switches SW(1) to (180).

On the other hand, the print signal PRTS (see FIG. 10) is a data signal including 180 sets of 2-bit data for driving the piezo elements (1) to (180), and is a signal that indicates, for example, whether or not ink is to be ejected from the nozzles #1 to #180 and the size of ink that is to be ejected. The print signal PRTS is serially transmitted to the drive circuit 220, and is input to the 180 first shift registers 224(1) to (180). Then, the print signal PRTS is input to the second shift registers 226(1) to (180). Herein, data of the first bit, among the 180 sets of 2-bit data, is input to each of the first shift registers 224(1) to (180). Furthermore, data of the second bit, among the 180 sets of 2-bit data, is input to each of the second shift registers 226(1) to (180).

The latch circuit group 228 latches data stored in the first shift registers 224(1) to (180) and the second shift registers 226(1) to (180), and obtains the data as signals indicating "0 (low)" or "1 (high)". Then, the signals extracted based on data stored in the first shift registers 224(1) to (180) and the second shift registers 226(1) to (180) are output by the latch circuit group 228 to the data selector 230. The latch timing of the latch circuit group 228 is controlled by a latch signal (LAT) that is input to this latch circuit group 228. More specifically, if pulses as shown in FIG. 11 are input to the latch circuit group 228 as a latch signal (LAT), then the latch circuit group 228 latches data stored in the first shift registers 224(1) to (180) and the second shift registers 226(1) to (180). The latch circuit group 228 latches data every time pulses are input as a latch signal (LAT).

On the other hand, the data selector 230 selects signals corresponding to either one of the first shift registers 224(1) to (180) and the second shift registers 226(1) to (180), from among the signals (signals indicating "0 (low)" or "1 (high)") that are output from the latch circuit group 228, and outputs the signals as print signals PRT(1) to (180) respectively to the switches SW(1) to (180). The signals selected by the data selector 230 are switched based on both of a latch signal (LAT signal) and a change signal (CH signal) that are input to this data selector 230.

Herein, if pulses as shown in FIG. 11 are input to the data selector 230 as a latch signal (LAT signal), then the data selector 230 selects signals corresponding to data stored in the second shift registers 226(1) to (180), and outputs the signals as print signals PRT(1) to (180) respectively to the switches SW(1) to (180). Furthermore, if pulses as shown in FIG. 11 are input to the data selector 230 as a change signal (CH signal), then the data selector 230 switches signals to be selected from signals corresponding to data stored in the second shift registers 226(1) to (180) to signals corresponding to data stored in the first shift registers 224(1) to (180), and outputs the signals as print signals PRT(1) to (180) respectively to the switches SW(1) to (180). Then, when pulses are input again as a latch signal (LAT signal), then the data selector 230 switches signals to be selected from signals corresponding to data stored in the first shift registers 224(1) to (180) to signals corresponding to data stored in the second shift registers 226(1) to (180), and outputs the signals as print signals PRT(l) to (180) respectively to the switches Sw(1) to (180).

Herein, as shown in FIG. 11, in a latch signal (LAT signal), a pulse is generated at a cycle of one pixel unit. Furthermore, as shown in FIG. 11, in a change signal (CH signal), a pulse is generated at a timing that is at the middle of each cycle of one pixel. Accordingly, 2-bit data each corresponding to one pixel is serially transmitted to the switches SW(1) to (180). More specifically, 2-bit data such as "00", "01", "10", and "11" is input to the corresponding switches SW(1) to (180) as the print signals PRT(1) to (180) at each cycle of one pixel.

The switches SW(1) to (180) determine whether or not to let the original drive signal ODRV input from the original drive signal generating section pass through, based on the print signals PRT(1) to (180) output from the data selector 230, that is, 2-bit data such as "00", "01", "10", and "11". More specifically, if the level of a print signal PRT(i) is "1 (high)", then a drive pulse (first pulse W1 or second pulse W2) corresponding to the original drive signal ODRV is led to pass through to be a drive signal DRV(i). On the other hand, if the level of a print signal PRT(i) is "0 (low)", then the switches SW(1) to (180) block a drive pulse (first pulse W1 or second pulse W2) corresponding to the original drive signal ODRV.

Accordingly, as shown in FIG. 11, the drive signal DRV(i) that is input from switches SW(1) to (180) to the piezo elements PZT(1) to (180) varies in accordance with the print signals PRT(1) to (180) input from the data selector 230 to the switches SW(1) to (180), that is, 2-bit data such as "00", "01", "10", and "11".

Herein, if "10" is input to the switch SW(i) as the print signal PRT(i), then only the first pulse W1 passes through the switch SW(i) and is input to the piezo element PZT(i). The piezo element PZT(i) is driven with this first pulse W1, and an ink droplet of a small size (hereinafter, also referred to as "small ink droplet") is ejected from the nozzle. Accordingly, a dot of a small size (medium dot) is formed on the medium S.

Furthermore, if "01" is input to the switch SW(i) as the print signal PRT(i), then only the second pulse W2 passes through the switch SW(i) and is input to the piezo element PZT(i). The piezo element PZT(i) is driven with this second pulse W2, and an ink droplet of a size that is larger than the previous small size (hereinafter, also referred to as "middle ink droplet") is ejected from the nozzle. Accordingly, a dot of a middle size (medium dot) is formed on the medium S.

Furthermore, if "11" is input to the switch SW(i) as the print signal PRT(i), then both the first pulse W1 and the second pulse W2 pass through the switch SW(i) and are input to the piezo element PZT(i). The piezo element PZT(i) is driven with the first pulse W1 and the second pulse W2, and a small ink droplet and a middle ink droplet are ejected from the nozzle. The small ink droplet and the middle ink droplet are ejected successively with a predetermined interval. Accordingly, a small dot formed with the small ink droplet and a medium dot formed with the middle ink droplet are formed on the medium S. The small dot and the medium dot form a dot of a size that looks large (large dot) on the medium S.

Furthermore, if "00" is input to the switch SW(i) as the print signal PRT(i), then neither the first pulse W1 nor the second pulse W2 passes through the switch Sw(i), and no drive pulse is input to the piezo element PZT(i). Accordingly, no ink droplet is ejected from the nozzle, and no dot is formed on the medium S.

<PTS Signal>

The latch signal (LAT signal) and the change signal (CH signal) that are input to the latch circuit group 228 or the data selector 230 are generated based on a PTS (pulse timing signal) signal. The PTS signal is a signal that defines a timing at which pulses are generated in the latch signal (LAT signal) and the change signal (CH signal). Pulses for the PTS signal are generated based on the output pulses ENC-A and ENC-B from the linear encoder 51 (detecting section 466). In other words, pulses for the PTS signal are generated in accordance with the amount that the carriage 41 has moved. It should be noted that the PTS signal corresponds to "a signal serving as a reference for causing the ink to be ejected at a same timing from the plurality of nozzles".

Figure 12:
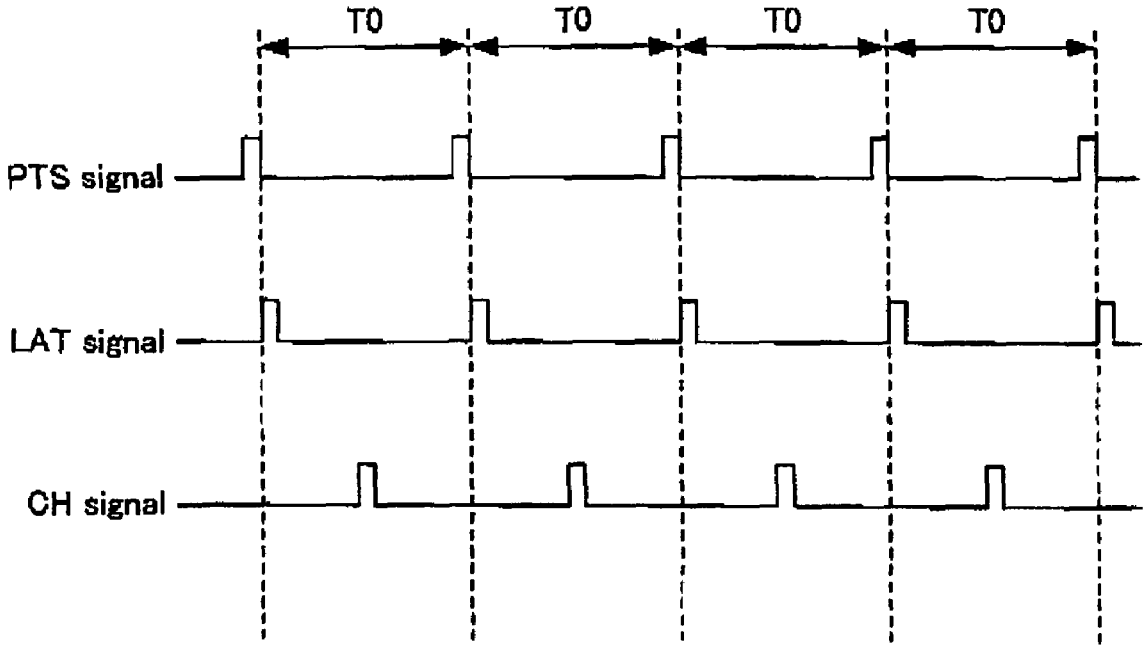
FIG. 12 is a timing chart of signals.

FIG. 12 illustrates in detail the relationship between timings of the PTS signal, the latch signal (LAT signal), and the change signal (CH signal). In the PTS signal, pulses are generate data predetermined cycle T0. In the latch signal (LAT signal) and the change signal (CH signal), pulses are generated based on the pulses generated in the PTS signal. Immediately after a pulse is generated in the PTS signal, a pulse for the latch signal (LAT signal) is generated in response to that. On the other hand, when a predetermined time has passed after a pulse is generated in the PTS signal, a pulse in the change signal (CH signal) is generated. Pulses in the latch signal (LAT signal) and the change signal (CH signal) are generated every time a pulse is generated in the PTS signal.

The PTS signal is generated by the controller 126. The controller 126 generates pulses for the PTS signal based on the output pulses ENC-A and ENC-B from the linear encoder 51 (detecting section 466), and changes a timing and a cycle at which pulses are generated, as appropriate, based on print data sent from the computer 140. The PTS signal that has been generated by the controller 126 is output to the head drive section 132. The head drive section 132 generates the latch signal (LAT signal) and the change signal (CH signal) based on the PTS signal from the controller 126 and the original drive signal ODRV is generated at the original drive signal generating section 222.

It should be noted that the controller 126 for generating a PTS signal and outputting it to the head drive section 132 corresponds to "signal outputting section".

Printing Operation

Figure 13:
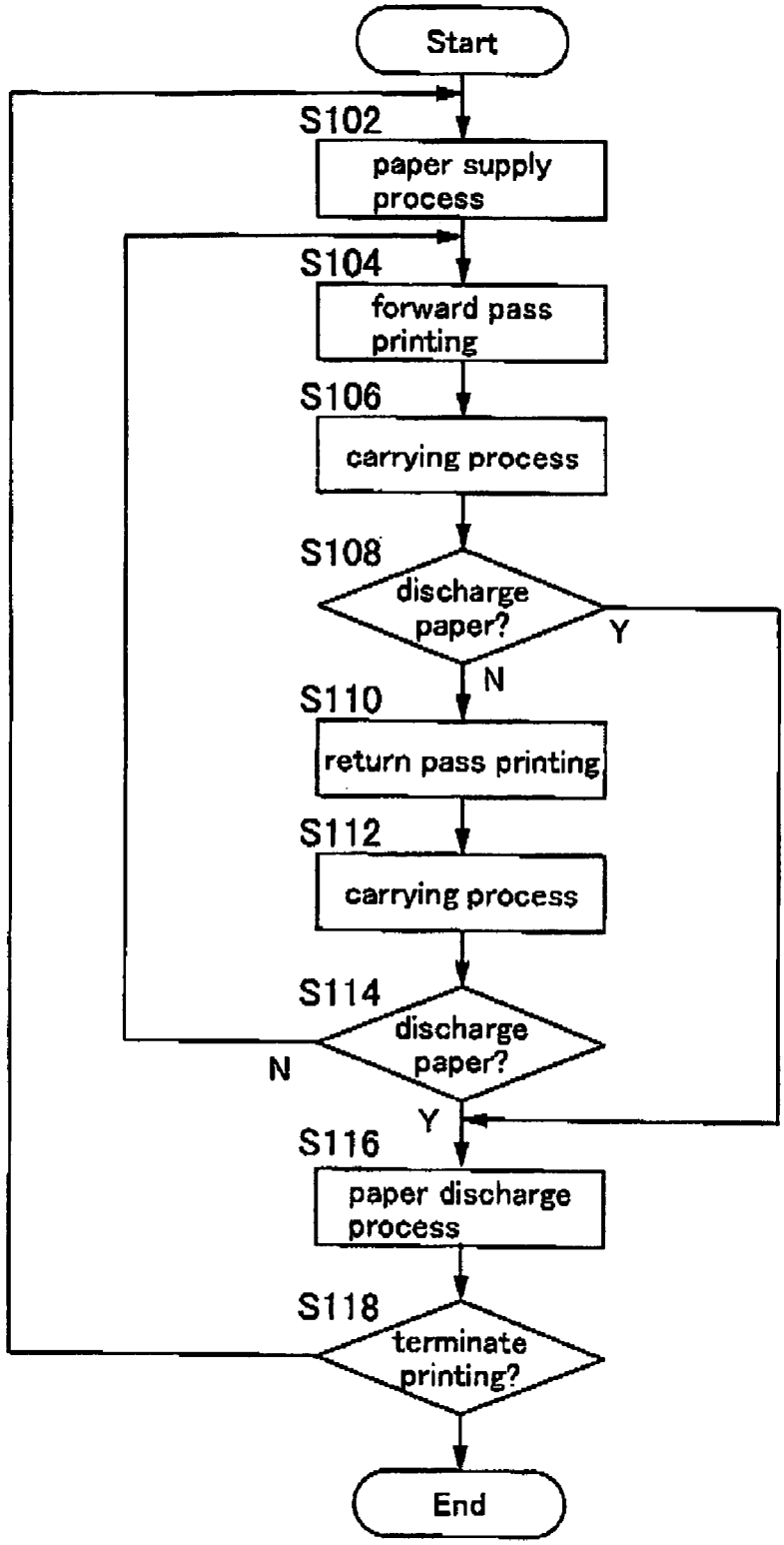
FIG. 13 is a flowchart illustrating an example of a printing process.

The following is a description concerning a printing operation of the above-described inkjet printer 1. Here, an example of "bidirectional printing" is explained. FIG. 13 is a flowchart showing an example of a processing procedure of the printing operation of the inkjet printer 1. The processes described below are each performed when the controller 126 reads out programs from the main memory 127 and controls each of the carriage motor control section 128, the carry control section 130, and the head drive section 132, for example, in accordance with the programs.

When the controller 126 receives print data from the computer 140, in order to perform printing in accordance with the print data, first, a paper supply process is carried out (S102). In the paper supply process, a medium S to be printed is supplied into the inkjet printer 1 and carried to a print start position (also referred to as "print start position"). The controller 126 rotates the paper supply roller 13 to send the medium S to be printed up to the carry roller 17A. The controller 126 rotates the carry roller 17A to position the medium S that has been sent from the paper supply roller 13 at the print start position (upstream on the platen 14).

Next, the controller 126 carries out a printing process in which the medium S is printed while moving the carriage 41 relative to the medium S by driving the carriage motor 42 via the carriage motor control section 128. Here, first, forward pass printing in which ink is ejected from the head 21 is performed while moving the carriage 41 in one direction along the guide rail 46 (S104). The controller 126 moves the carriage 41 by driving the carriage motor 42, and ejects ink by driving the head 21 in accordance with the print data (corresponding to "moving-and-ejecting operation"). The ink ejected from the head 21 reaches the medium S, forming dots.

After performing printing in this manner, the controller 126 carries out a carrying process for carrying the medium S by a predetermined amount (S106). The carrying process corresponds to "carrying operation". In this process, the controller 126 rotates the carry roller 17A by driving the carry motor 15 via the carry control section 130, and carries the medium S only by a predetermined amount in the carrying direction relative to the head 21. With this carrying process, the head 21 can print onto a region that is different from the region printed on before.

After carrying out the carrying process in this manner, the controller 126 carries out a paper discharge determination in which it is determined whether or not to discharge the paper (S108). Herein, the controller 126 carries out a paper discharge process if there is no more data to be printed onto the medium S that is currently being printed (S116). On the other hand, if there is data left to be printed onto the medium S that is currently being printed, then the controller 126 carries out return pass printing without performing a paper discharge process (S110). In this return pass printing, printing is performed while moving the carriage 41 along the guide rail 46 in the opposite direction to the previous forward pass printing. Also here, the controller 126 moves the carriage 41 by rotatively driving the carriage motor 42 in the opposite direction as before via the carriage motor control section 128, ejects ink by driving the head 21 based on the print data, and performs printing.

After return pass printing has been performed, a carrying process is carried out (S112), and then a paper discharge determination is carried out (S114). Here, if there is data left to be printed onto the medium S that is currently being printed, then no paper discharge process is carried out, the procedure returns to step S104, and forward pass printing is performed again (S104). On the other hand, a paper discharge process is carried out if there is no more data to be printed onto the medium S that is currently being printed (S116).

After the paper discharge process has been carried out, a print termination determination is carried out in which it is determined whether or not to terminate printing (S118). Here, based on the print data from the computer 140, it is checked whether or not there is a further medium S to be printed left. If there is a further medium S to be printed left, then the procedure returns to step S102, another paper supply process is carried out, and printing is started. On the other hand, if no further medium S to be printed is left, then the printing process is terminated.

Print Modes

<Interlaced Mode>

Figure 14A:
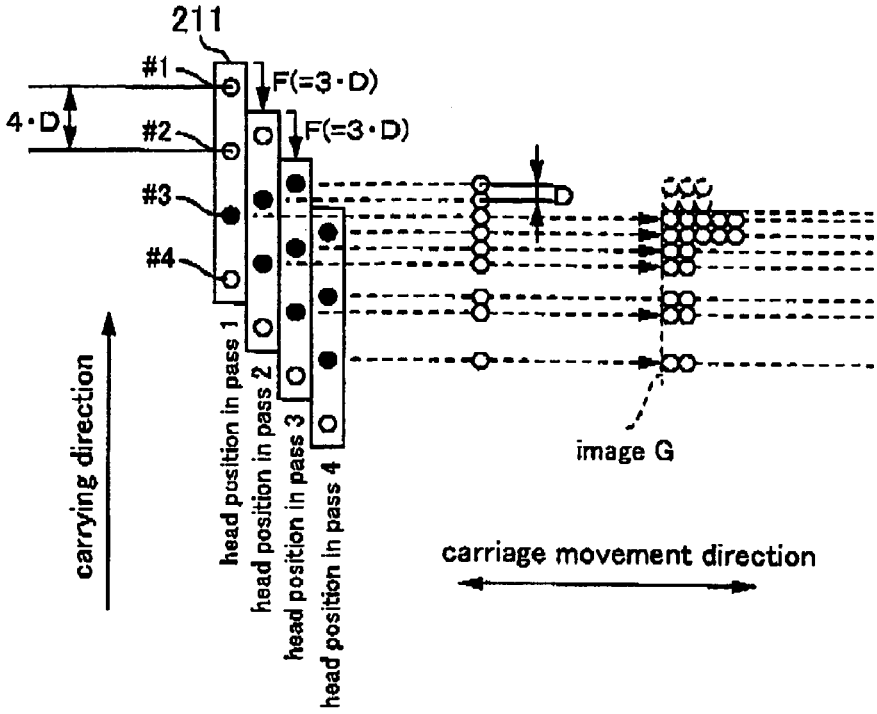
FIG. 14A is an explanatory diagram illustrating an example of an image printing procedure in the interlaced mode.
Figure 14B:
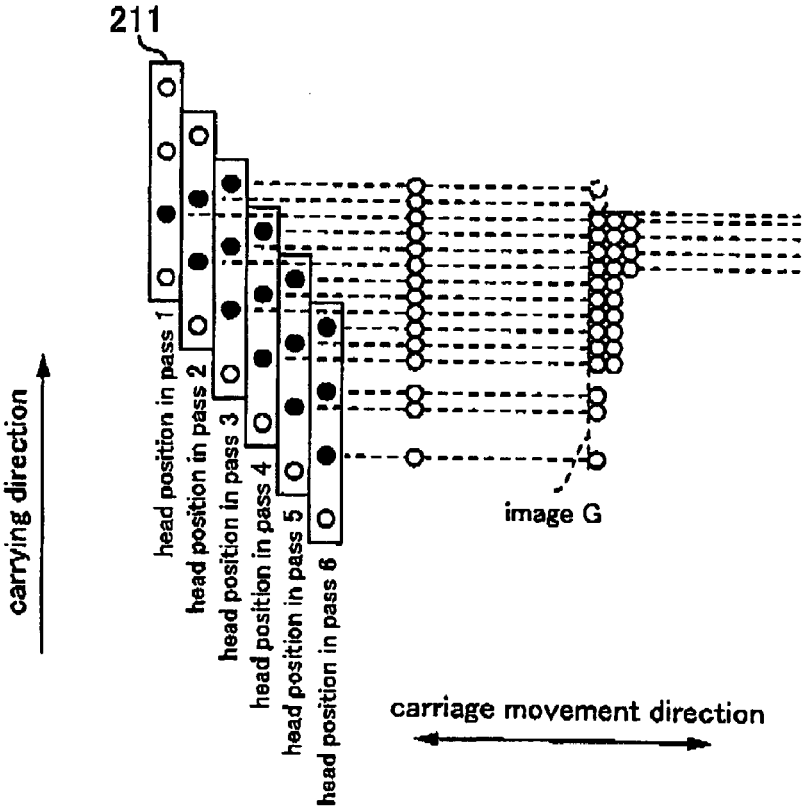
FIG. 14B is an explanatory diagram illustrating an example of an image printing procedure in the interlaced mode.

FIGS. 14A and 14B schematically illustrate a method for printing an image G by forming dots on the medium S in the interlaced mode. Here, for convenience, it is shown that the nozzle row 211 for ejecting ink moves along the medium S, but FIGS. 14A and 14B show the relative positional relationship between the nozzle row 211 and the medium S, and the medium S moves in the carrying direction in the actual state. In FIGS. 14A and 14B, the nozzles represented by black circles are the nozzles that eject ink, and the nozzles represented by white circles are nozzles that do not eject ink. FIG. 14A shows the positions of the nozzle row 211 (head 21) and the manner in which dots are formed in passes 1 to 4, and FIG. 14B shows the positions of the nozzle row 211 (head 21) and the manner in which dots are formed in passes 1 to 6.

Here, "pass" refers to an operation in which due to the movement of the carriage 41, the head 21 having the nozzle rows 211 is moved in a single carry in its movement direction. In the "interlaced mode", by repeatedly executing such a "pass", dots are formed in lines in the movement direction of the carriage 41 in each pass, and the image G is printed by forming successive raster lines constituting the image G to be printed. It should be noted that "raster line" refers to a row of pixels lined up in the movement direction of the carriage 41 and is also referred to as "scanning line." Furthermore, "pixels" are the square boxes that are determined virtually on the medium S in order to define the positions where ink droplets are caused to land so as to record dots.

In the interlaced mode, every time the medium S is carried in the carrying direction by a constant carry amount F, the nozzles record a raster line immediately above the raster line that was recorded in the immediately prior pass. In order to carry out recording in this manner with a constant carry amount, the number N (integer) of nozzles that can eject ink is coprime to k and the carry amount F is set to ND.

Here, it is shown how an image G is formed using the nozzles #1 to #4 of the nozzles #1 to #180 of the nozzle row 211. It should be noted that since the nozzle pitch of the nozzle row 211 is 4D, not all the nozzles can be used so that the condition for the interlaced mode, that is, "N and k are coprime", is satisfied. Accordingly, a simplified case is described here in which an image G is formed in the interlaced mode using three nozzles #1 to #3. Furthermore, since three nozzles are used, the medium S is carried by a carry amount of 3·D. As a result, using a nozzle row 211 with a nozzle pitch of 180 dpi (4-D) for example, dots are formed on the paper with a dot spacing of 720 dpi (=D).

FIGS. 14A and 14B show the manner in which continuous raster lines are formed, with the first raster line being formed by the nozzle #1 in the pass 3, the second raster line being formed by the nozzle #2 in the pass 2, the third raster line being formed by the nozzle #3 in the pass 1, and the fourth raster line being formed by the nozzle #1 in the pass 4. It should be noted that only the nozzle #3 ejects ink in the pass 1 and only the nozzle #2 and the nozzle #3 eject ink in the pass 2. The reason for this is that if ink is ejected from all of the nozzles in the pass 1 and the pass 2, continuous raster lines cannot be formed on the medium S. In the pass 3 and thereafter, the three nozzles (#1 to #3) eject ink and the paper is carried by a constant carry amount F (=3·D), and thus continuous raster lines are formed with a dot spacing of D. Thus, raster lines are formed successively in each pass, and the image G is printed.

Figure 15A:
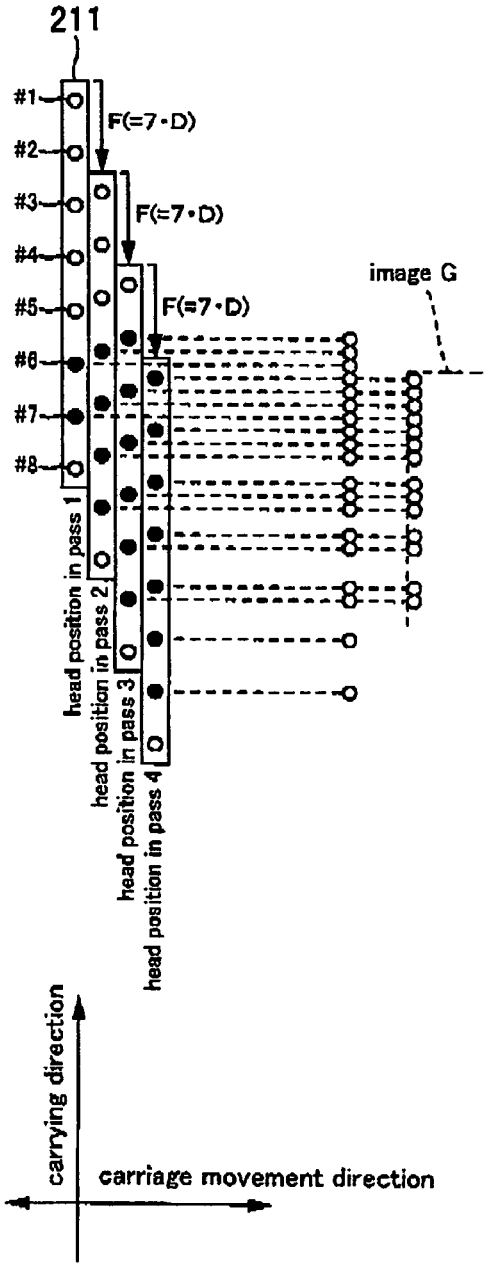
FIG. 15A is an explanatory diagram illustrating an image printing procedure in another interlaced mode.
Figure 15B:
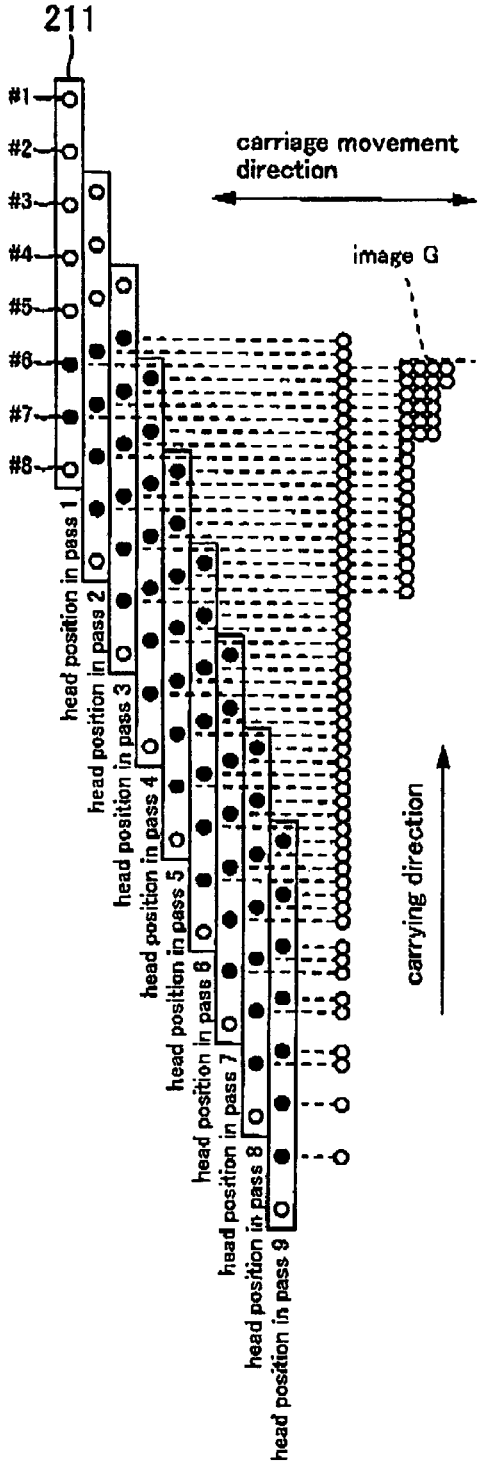
FIG. 15B is an explanatory diagram illustrating an image printing procedure in another interlaced mode.

FIGS. 15A and 15B illustrate other methods in the interlaced mode. Here, the number of nozzles used is different. The nozzle pitch, for example, is the same as in the case of the above-described explanatory diagrams, so that the description thereof is omitted. FIG. 15A shows the positions of the nozzle row 211 and the manner in which dots are formed in passes 1 to 4, and FIG. 15B shows the positions of the nozzle row 211 and the manner in which dots are formed in passes 1 to 9.

FIGS. 15A and 15B illustrate an example in which an image G is printed on the medium S using #1 to #8 of the nozzles #1 to #180 of the nozzle row 211. Here, since the nozzle pitch of the nozzle row 211 is 4D, not all the nozzles can be used so that the condition for the interlaced mode, that is, "N and k are coprime", is satisfied. Accordingly, a simplified case is described here in which the interlaced mode is performed using seven nozzles #1 to #7. Since seven nozzles #1 to #7 are used, the carry amount of the medium S is set to "7·D".

This drawings show the manner in which continuous raster lines are formed, with the first raster line being formed by the nozzle #2 in the pass 3, the second raster line being formed by the nozzle #4 in the pass 2, the third raster line being formed by the nozzle #6 in the pass 1, and the fourth raster line being formed by the nozzle #1 in the pass 4. In the pass 3 and thereafter, the seven nozzles (#1 to #7) eject ink and the medium S is carried by a constant carry amount F (=7·D), and thus continuous raster lines are formed with a dot spacing of D.

Compared with the above-described interlaced mode, the number of nozzles used for ejecting ink is larger. Therefore, the number N of nozzles that eject ink is increased, so that the carry amount F during a single carry is increased, and thus the printing speed is increased. In this manner, in the interlaced mode, it is advantageous to increase the number of nozzles that can eject ink because this increases the printing speed.

<Overlap Mode>

Figure 16A:
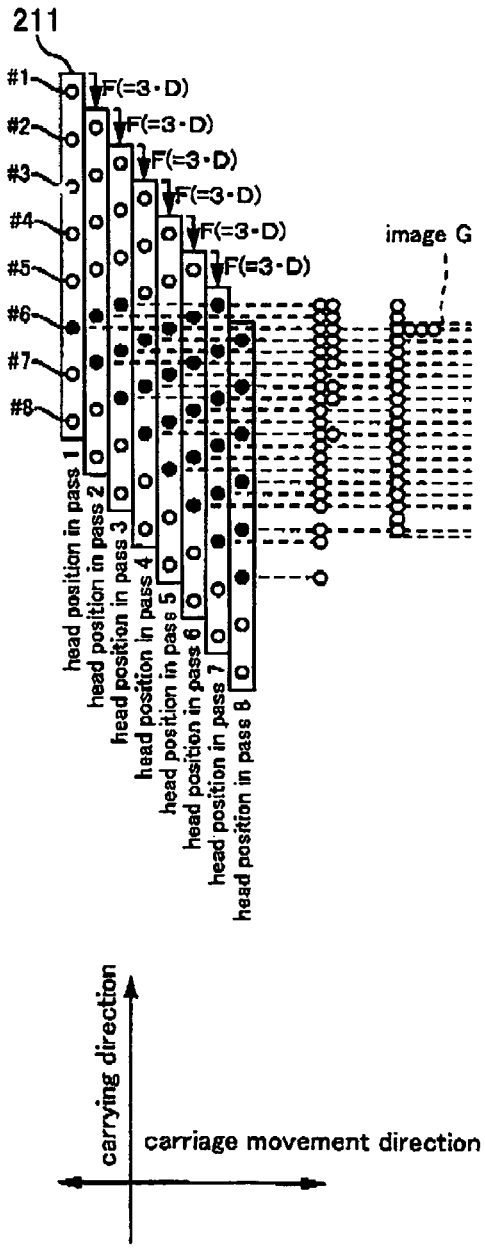
FIG. 16A is an explanatory diagram illustrating an example of an image printing procedure in the overlap mode.
Figure 16B:
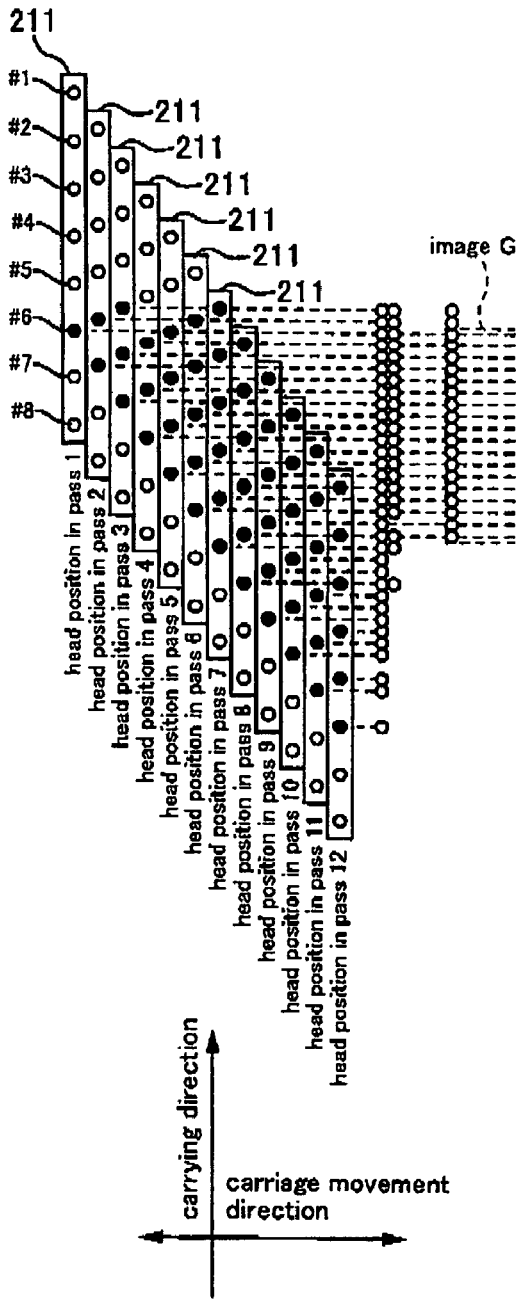
FIG. 16B is an explanatory diagram illustrating an example of an image printing procedure in the overlap mode.

FIGS. 16A and 16B schematically illustrate a method for printing an image G on a medium S in the overlap mode. FIG. 16A shows the positions of the nozzle row 211 and the manner in which dots are formed in passes 1 to 8, and FIG. 16B shows the positions of the nozzle row 211 and the manner in which dots are formed in passes 1 to 12. In the above-described interlaced mode, a single raster line was formed by a single nozzle. In the overlap mode, however, a single raster line for example is formed with two or more nozzles.

In the overlap mode, each time the medium S is carried in the carrying direction by the constant carry amount F, the nozzles form dots intermittently at every several dots. Then, by letting another nozzle form dots in another pass to complement the intermittent dots that have already been formed, a single raster line is completed by a plurality of nozzles. The overlap number M is defined as the number of passes required to complete a single raster line. In FIGS. 16A and 16B, since each nozzle forms dots intermittently at every other dot, dots are formed in every pass either at the uneven numbered pixels or at the even numbered pixels. Since a single raster line is formed by two nozzles, the overlap number is M=2. It should be noted that the overlap number is M=1 in the case of the interlaced mode described above.

In the overlap mode, the following conditions (1) to (3) are required in order to perform recording with a constant carry amount.

(1) N/M is an integer.

(2) N/M is coprime to k.

(3) The carry amount F is set to (N/M)·D.

In FIGS. 16A and 16B, the nozzle number of the nozzle row 211 is 180. However, since the nozzle pitch of the nozzle row 211 is 4D (k=4), not all the nozzles can be used so that the condition for printing in the overlap mode, that is, "N/M and k are coprime", is satisfied. Accordingly, a simplified example is described here in which an image G is printed using nozzles #1 to #6 of the nozzles #1 to #180 of the nozzle row 211. Since six nozzles are used, the medium S is carried by a carry amount of 3·D. As a result, using a nozzle row with a nozzle pitch of 180 dpi (4·D) for example, dots are formed on the medium S with a dot spacing of 720 dpi (=D). Furthermore, in a single pass, the nozzles form dots in the scanning direction intermittently at every other dot. In FIGS. 16A and 16B, raster lines are already completed in which two dots are drawn in the carriage movement direction. For example, in FIG. 16A, the first through the sixth raster lines have been already completed. Raster lines in which only one dot is drawn are raster lines in which dots have been formed intermittently at every other dot. For example, in the seventh and the tenth raster lines, dots are formed intermittently at every other dot. It should be noted that the seventh raster line, in which dots have been formed intermittently at every other dot, is completed by having the nozzle #1 form dots to fill it up in the pass 9.

FIGS. 16A and 16B show the manner in which continuous raster lines are formed, with the first raster line being formed by the nozzle #4 in the pass 3 and the nozzle #1 in the pass 7, the second raster line being formed by the nozzle #5 in the pass 2 and the nozzle #2 in the pass 6, the third raster line being formed by the nozzle #6 in the pass 1 and the nozzle #3 in the pass 5, and the fourth raster line being formed by the nozzle #4 in the pass 4 and the nozzle #1 in the pass 8. It should be noted that in the passes 1 to 6, some of the nozzles #1 to #6 do not eject ink. The reason for this is that if ink is ejected from all of the nozzles in the passes 1 to 6, continuous raster lines cannot be formed on the medium S. In the pass 7 and thereafter, the six nozzles (#1 to #6) eject ink and the medium S is carried by a constant carry amount F (=3·D), and thus continuous raster lines are formed with a dot spacing of D.

The following shows a summary of the formation position in the scanning direction of dots that are formed in the respective passes.

| | pass | | | | | | | |
|---|---|---|---|---|---|---|---|---|
| | 1 | 2 | 3 | 4 | 5 | 6 | 7 | 8 |
| recorded pixel | odd | even | odd | even | even | odd | even | odd |

Here, "odd" refers to a state in which dots are formed at odd-numbered pixels of the pixels (pixels in a raster line) lined up in the carriage movement direction. Furthermore, "even" in the table refers to a state in which dots are formed at even-numbered pixels of the pixels lined up in the scanning direction. For example, in the pass 3, the nozzles form dots at odd-numbered pixels. When a single raster line is formed by M nozzles, k×M passes are required in order to complete the number of raster lines corresponding to the nozzle pitch. For example, in this embodiment, a single raster line is formed by two nozzles, so that 8 (4×2) passes are required in order to complete four raster lines. As can be seen from Table 1, in the four passes during the first half, dots are formed in the order of odd-even-odd-even. As a result, when the four passes during the first half have been finished, dots are formed at even-numbered pixels in raster lines adjacent to raster lines in which dots are formed at odd-numbered pixels. In the four passes during the second half, dots are formed in the order of even-odd-even-odd. In other words, in the four passes during the second half, dots are formed in reverse order with respect to the four passes during the first half. As a result, dots are formed so as to fill up gaps between the dots that have been formed in passes during the first half.

Also in the overlap mode, when the number N of nozzles that can eject ink is increased, the carry amount F during a single carry is increased, and thus the printing speed is increased, as in the above-described interlaced mode. Therefore, in the overlap mode, it is advantageous to increase the number of nozzles that can eject ink because this increases the printing speed.

<Other Print Modes>

As print modes other than the interlaced mode and the overlap mode, there are band printing and draft printing, for example.

Conventional Problems

In the inkjet printer 1 as described above, there are cases in which the head 21 is installed at an angle with respect to the movement direction (corresponding to "movement direction of the nozzles") of the carriage 41. The followings are conceivable as the main causes for which the head 21 is installed at an angle in this manner. (A) The head 21 is fixed at an angle within an error range in manufacturing. (B) In a case where the head 21 is installed in a removable manner, when the head 21 is removed for maintenance or other reasons and then the head 21 is attached again, the head 21 is installed at an angle.

Figure 17:
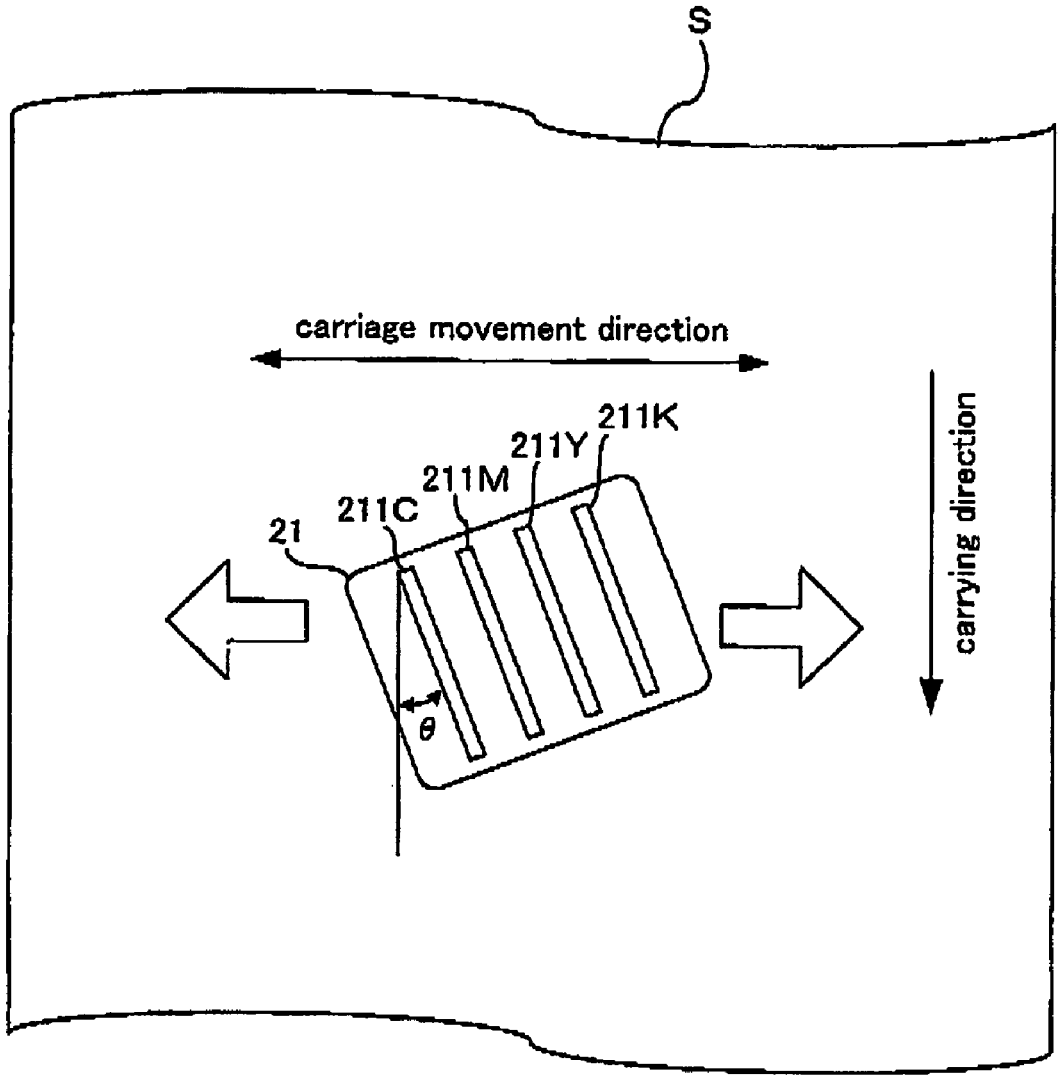
FIG. 17 is an explanatory diagram for describing the conventional problems.

FIG. 17 shows an example in which the head 21 is installed at an angle. Here, as shown in FIG. 17, the head 21 is installed at an angle to the left. When the head 21 is installed at an angle with respect to the movement direction of the carriage 41, each of the nozzle rows 211C, 211M, 211Y, and 211K provided at the head 21 is not disposed perpendicularly to the movement direction of the carriage 41, but disposed at an angle. Accordingly, each of the nozzle rows 211C, 211M, 211Y, and 211K is not disposed in parallel with the carrying direction of the medium S, but disposed at an angle with respect to the carrying direction of the medium S. Accordingly, the arrangement of the nozzles #1 to #180 is at an angle with respect to the carrying direction of the medium S, and thus a trouble is caused that dots are formed at an angle when ink is ejected from the nozzles #1 to #180.

Figure 18:
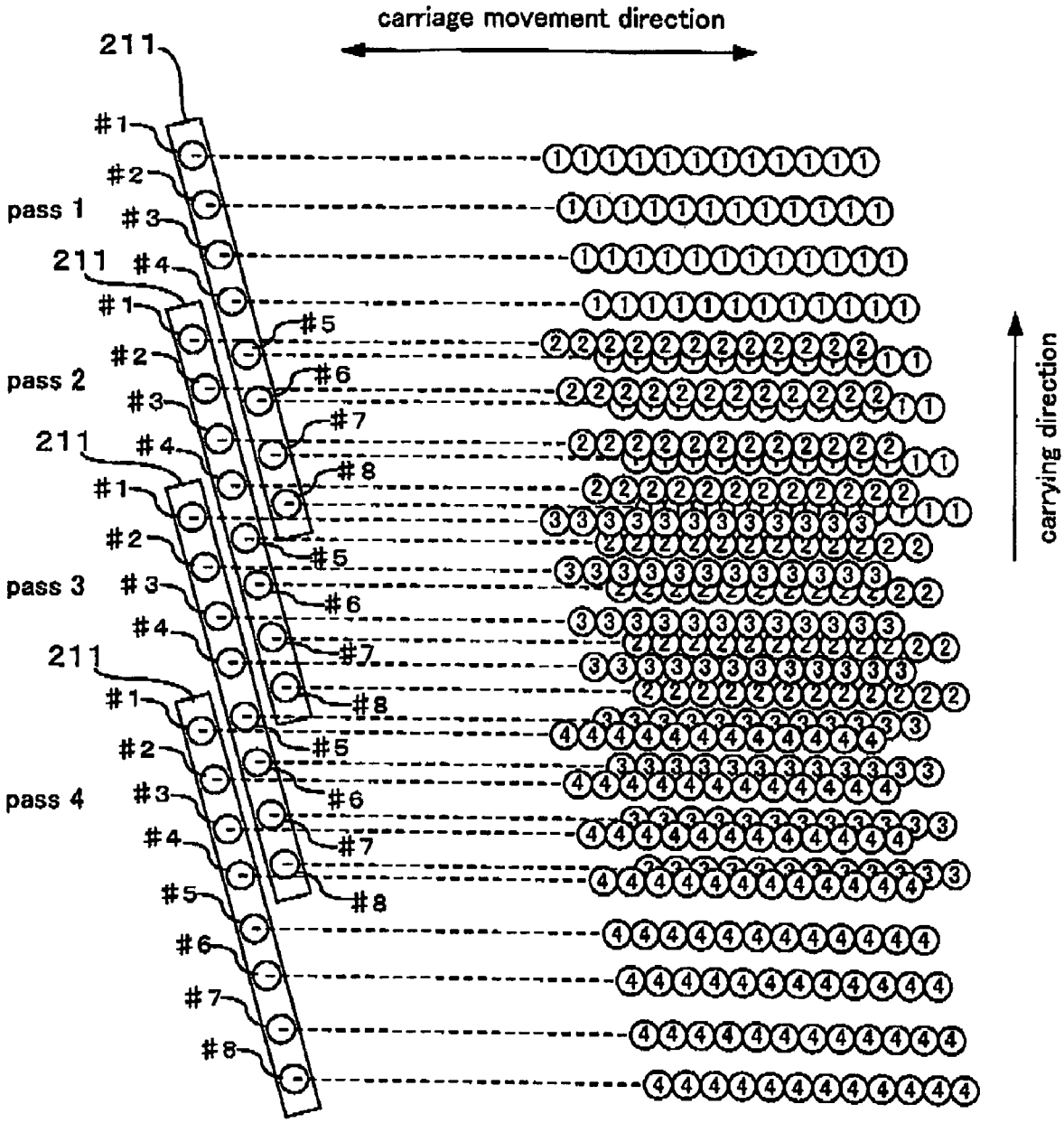
FIG. 18 is an explanatory diagram for describing the conventional problems.

FIG. 18 illustrates an example of how dots are formed in a case where the head 21 is installed at an angle with respect to its movement direction. A simplified example is described here in which the nozzle row 211 has eight nozzles #1 to #8. Furthermore, an operation is described in which due to the movement of the carriage 41, the nozzle row 211 is moved in its movement direction, that is, in this embodiment, a case in which the so-called "pass" is performed four times. The positions of dots formed in the first pass ("pass 1") are represented by circles numbered as "1". The positions of dots formed in the second pass ("pass 2") are represented by circles numbered as "2". The positions of dots formed in the third pass ("pass 3") are represented by circles numbered as "3". The positions of dots formed in the fourth pass ("pass 4") are represented by circles numbered as "4".

As shown in FIG. 18, in a case where the nozzle row 211 is installed at an angle with respect to the carrying direction of the medium S, when the nozzle row 211 is moved due to the movement of the carriage 41 and ink is ejected from the nozzles #1 to #8, dots formed with the ejected ink are formed at an angle and in parallel with the arrangement direction of the nozzles #1 to #8 (see circles numbered as "1" in the drawing). It should be noted that ink is ejected at the same timing from the nozzles #1 to #8.

Furthermore, when the movement of the carriage 41 has been finished ("pass 1" has been finished) and the next pass ("pass 2") is performed, the medium S is carried only by a predetermined amount in the carrying direction. Accordingly, as shown in FIG. 18, the medium S is moved upward relative to the nozzle row 211. Here, when the carriage 41 starts the movement again, the nozzle row 211 moves in the movement direction of the carriage 41 in a tilted orientation. Thus, dots formed with ink ejected from the nozzles #1 to #8 are formed at an angle in tandem along the arrangement direction of the nozzles #1 to #8, as in the case of "pass 1". The positions of the formed dots are represented by circles numbered as "2". In this manner, when dots (circles numbered as "2") are formed at an angle in "pass 2", the dots (circles numbered as "2") formed in "pass 2" are formed at the positions significantly shifted relative to the dots (circles numbered as "1") formed in "pass 1".

Furthermore, in a case where "pass 2" has been finished and the next pass ("pass 3") is performed, when the medium S is moved upward relative to the nozzle row 211 and the carriage 41 is moved relative to the medium S, then dotes formed with ink ejected from the nozzles #1 to #8 are formed at an angle in tandem along the arrangement direction of the nozzles #1 to #8 as shown with the circles numbered as "3" in the drawing. In this manner, when dots (circles numbered as "3") are formed at an angle in "pass 3", the dots (circles numbered as "3") formed in "pass 3" are formed at the positions significantly shifted relative to the dots (circles numbered as "2") formed in "pass 2".

Furthermore, when the medium S is moved further upward relative to the nozzle row 211 and "pass 4" is performed, dots formed with ink ejected from the nozzles #1 to #8 are formed at an angle in tandem along the arrangement direction of the nozzles #1 to #8 as shown with the circles numbered as "4" in the drawing. In this manner, when dots (circles numbered as "4") are formed at an angle in "pass 4", the dots (circles numbered as "4") formed in "pass 3" are formed at the positions significantly shifted relative to the dots (circles numbered as "3") formed in "pass 3".

When "pass 1" to "pass 4" are performed in a state where the nozzle row 211 is installed at an angle with respect to the carrying direction of the medium S in this manner, there are cases in which dots (circles numbered as "1" to "4") formed with ink ejected from the nozzles #1 to #8 in "pass 1", to "pass 4" are formed at the positions shifted from one another, and thus pixels constituting an image to be printed cannot be formed properly. Accordingly, the constitution of an image to be printed is disordered significantly, so that the image quality of a print image is significantly affected.

Figure 19:
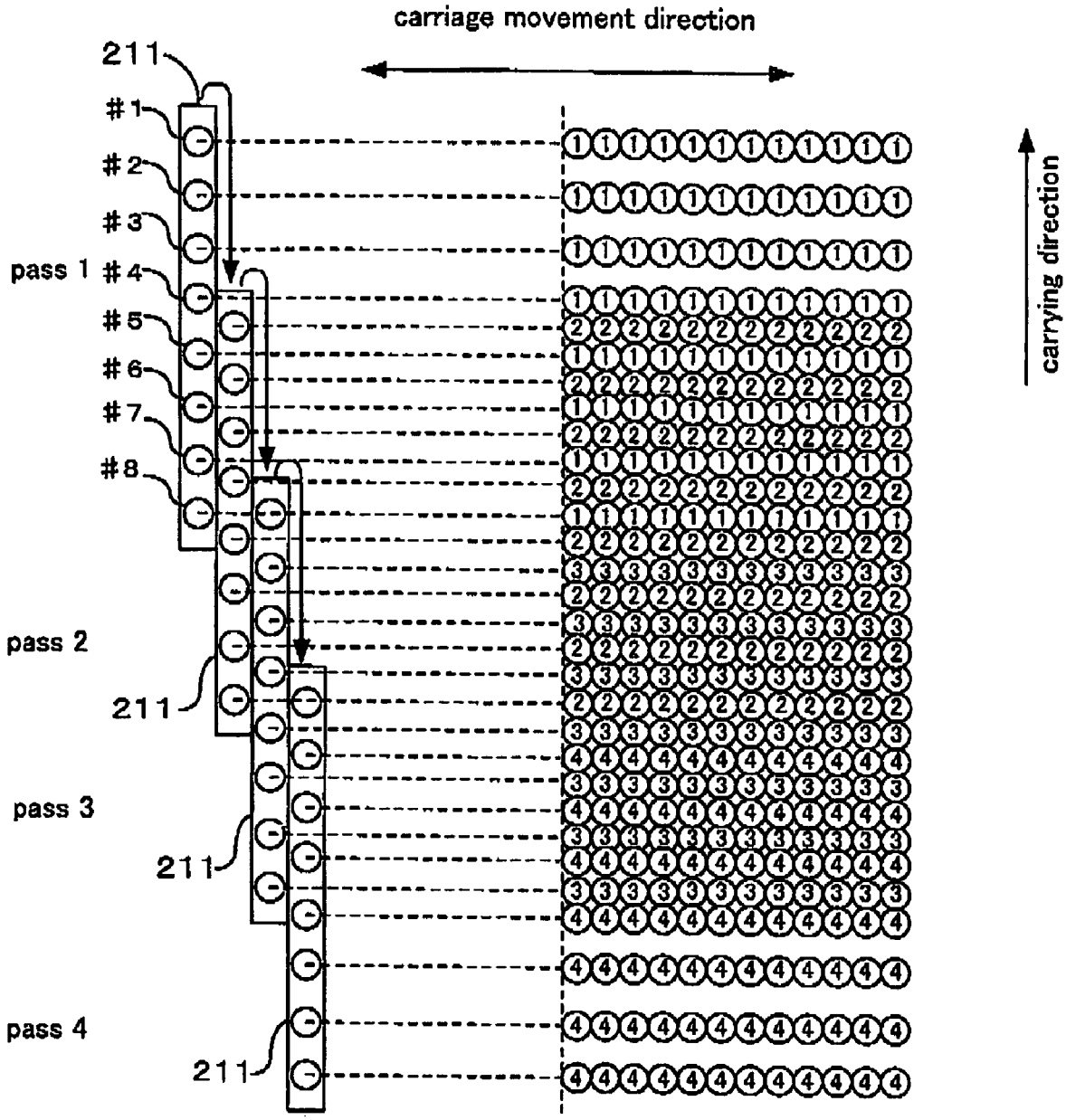
FIG. 19 is an explanatory diagram illustrating how dots are arranged in a case where printing is normally carried out.

FIG. 19 shows how dots are formed in a case where the head 21 is not at an angle with respect to the movement direction of the carriage 41 but it is installed properly. As shown in FIG. 19, when the head 21 is not at an angle with respect to the movement direction of the carriage 41, the nozzle row 211 is disposed in parallel with the carrying direction of the medium S. Accordingly, the nozzles #1 to #180 of the nozzle row 211 are arranged in parallel with the carrying direction of the medium S. Thus, when the nozzle row 211 is moved in the movement direction of the carriage 41 due to the movement of the carriage 41 and ink is ejected from the nozzles #1 to #8, so as to perform "pass 1", dots formed with the ejected ink are formed in tandem in the carrying direction of the medium S as shown with the circles numbered as "1" in FIG. 19. In a similar manner, when "pass 2" to "pass 4" are performed, dots formed with ink ejected from the nozzles #1 to #8 are formed in tandem in the carrying direction of the medium S as shown with the circles numbered as "2" to "4" respectively for "pass 2" to "pass 4" in FIG. 19.

In this manner, when the head 21 is not at an angle with respect to the movement direction of the carriage 41 but it is installed properly, dots formed in "pass 1" to "pass 4" are not formed at the shifted position but formed in a properly arranged state as shown in FIG. 19. Accordingly, pixels constituting an image to be printed are properly formed and a print image of a high quality can be obtained.

Solution

With the inkjet printer 1 according to this embodiment, it is possible to prevent the arrangement of dots from being disordered and thus to suppress degradation in the image quality of an image to be printed even in a case where the head 21 is installed at an angle with respect to the movement direction of the carriage 41 as described above. This method is described in detail below.

Figure 20:
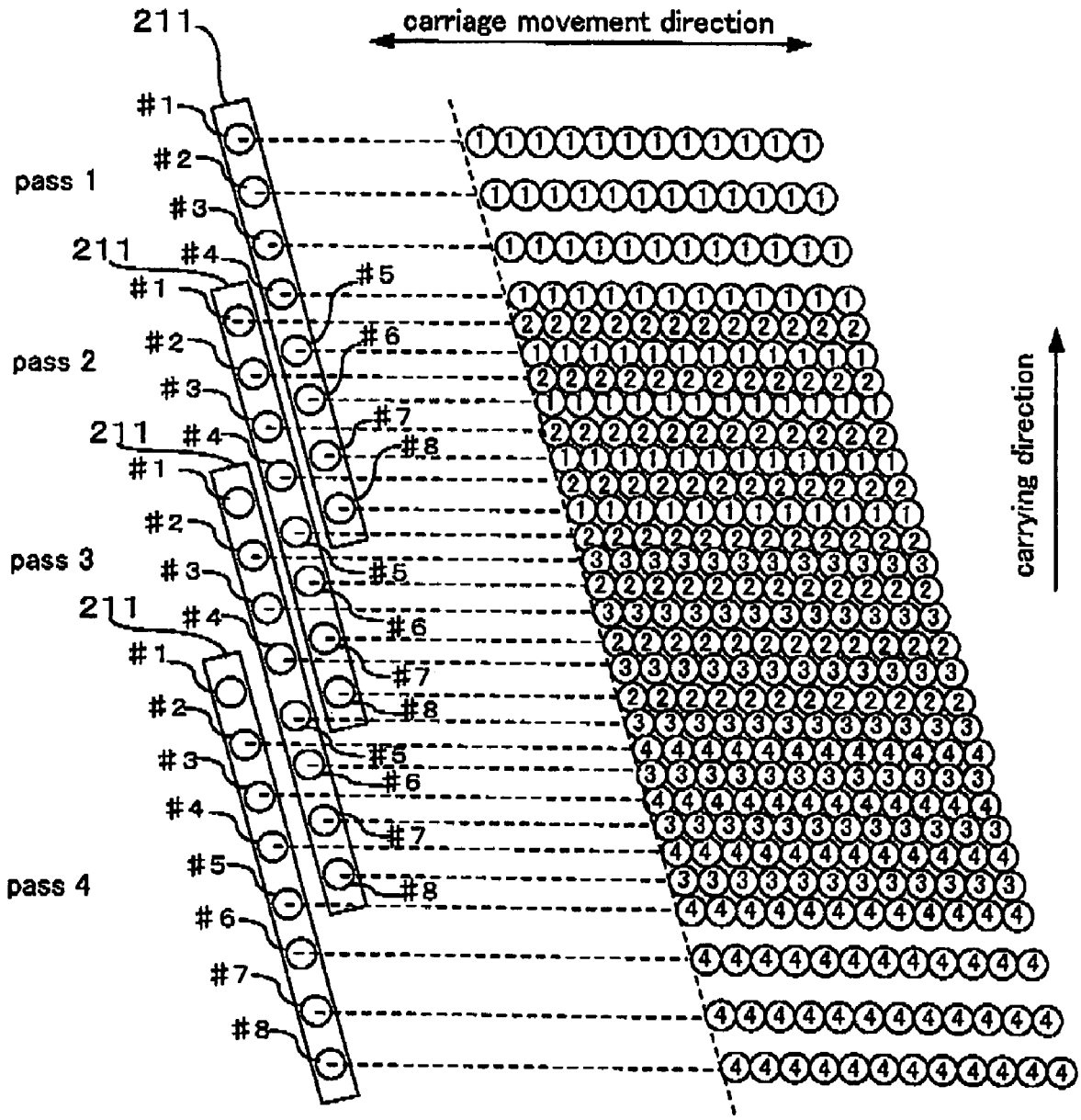
FIG. 20 is an explanatory diagram schematically illustrating a printing method.

FIG. 20 illustrates how dots are formed in a case where the head 21 is installed at an angle with respect to the movement direction of the carriage 41 in the inkjet printer 1 according to this embodiment. A simplified example is described here in which the nozzle row 211 has eight nozzles #1 to #8. Furthermore, an operation is schematically described in which, due to the movement of the carriage 41, the nozzle row 211 is moved in its movement direction, that is, the so-called "pass" is performed four times. The positions of dots formed in the first pass ("pass 1") are schematically represented by circles numbered as "1". The positions of dots formed in the second pass ("pass 3") are schematically represented by circles numbered as "2". The positions of dots formed in the third pass ("pass 3") are schematically represented by circles numbered as "3". The positions of dots formed in the fourth pass ("pass 4") are schematically represented by circles numbered as "4".

In the inkjet printer 1 according to this embodiment, when the head 21 is installed at an angle with respect to its movement direction, the nozzle row 211 is disposed not in parallel with the carrying direction of the medium S but at an angle as shown in FIG. 20. When the nozzle row 211 is moved in the movement direction of the carriage 41 due to the movement of the carriage 41, since ink is ejected at the same timing from the nozzles #1 to #8 of the nozzle row 211, dots formed with the ink ejected from the nozzles #1 to #8 are arranged at an angle in the arrangement direction of the nozzles #1 to #8 as shown in FIG. 20.

Here, when the movement of the carriage 41 has been finished ("pass 1" has been finished) and the next pass ("pass 2") is performed, the medium S is carried only by a predetermined amount in the carrying direction. Accordingly, as shown in FIG. 20, the medium S is moved upward relative to the nozzle row 211.

When the movement of the carriage 41 is started and ink is again ejected from the nozzles #1 to #8, so as to perform "pass 2", the nozzle row 211 moves in the movement direction of the carriage 41 in a tilted orientation. When the nozzle row 211 moves in the movement direction of the carriage 41 in this manner, ink is ejected at the same timing from the nozzles #1 to #8 of the nozzle row 211, and thus dots are formed at an angle on a medium with the ink ejected from the nozzles #1 to #8.

In this embodiment, the timing at which ink is ejected from the nozzles #1 to #8 is changed. The timing is changed in accordance with the positions (positions of circles numbered as "1") of dots formed with ink ejected from the nozzles #1 to #8 in the previous pass, that is, "pass 1". More specifically, the timing at which ink is ejected from the nozzles #1 to #8 is changed such that the positions (positions of circles numbered as "2") of dots formed with ink ejected from the nozzles #1 to #8 are aligned with the positions of dots (circles numbered as "1") formed in the previous pass, that is, "pass 1", as shown in FIG. 20. Thus, a state can be avoided in which the positions of dots (circles numbered as "1") formed in "pass 1" are not aligned with the positions of dots (circles numbered as "2") formed in "pass 2" as in conventional cases.

Furthermore, also when "pass 2" has been finished and the next pass ("pass 3") is performed, the timing at which ink is ejected from the nozzles #1 to #8 is changed in accordance with the positions (positions of circles numbered as "2") of dots formed in "pass 2". As shown with circles numbered as "3" in FIG. 20, dots formed with ink ejected from the nozzles #1 to #8 are formed at an angle in tandem along the arrangement direction of the nozzles #1 to #8, but they are arranged to be aligned with the positions of dots (circles numbered as "2") formed in "pass 2".

Also when "pass 4" is performed, the timing at which ink is ejected from the nozzles #1 to #8 is changed in accordance with the positions (positions of circles numbered as "13") of dots formed in "pass 3". As shown with circles numbered as "4" in FIG. 20, dots formed with ink ejected from the nozzles #1 to #8 are formed at an angle in tandem along the arrangement direction of the nozzles #1 to #8, but they are arranged to be aligned with the positions of dots (circles numbered as "3") formed in "pass 3".

Dots (circles numbered as "1" to "4") formed with ink from the nozzles #1 to #8 are formed such that they are gradually shifted in one direction (direction toward the right in the drawing in this embodiment) every time one of the passes, that is, "pass 1" to "pass 4" is performed.

When one of the passes, that is, "pass 1" to "pass 4" is performed in this manner, the timing at which ink is ejected from the nozzles #1 to #8 is changed. Thus, as shown in FIG. 20, although it is not possible to eliminate the aspect that dots formed with ink ejected from the nozzles #1 to #8 are formed at an angle, it is possible to align the dots in the arrangement. Thus, it is possible to avoid a situation in which the constitution of an image to be printed is significantly affected. Accordingly, it is possible to prevent the arrangement of dots from being disordered and thus suppress degradation in the image quality of an image to be printed, even in a case where the head 21 is installed at an angle with respect to the movement direction of the carriage 41.

Amount of Change in Ejection Timing

The amount of change when changing the timing for ejecting ink from the nozzles #1 to #180 is calculated based on the carry amount of the medium S and the inclination of dots actually formed on the medium S.

Figure 21:
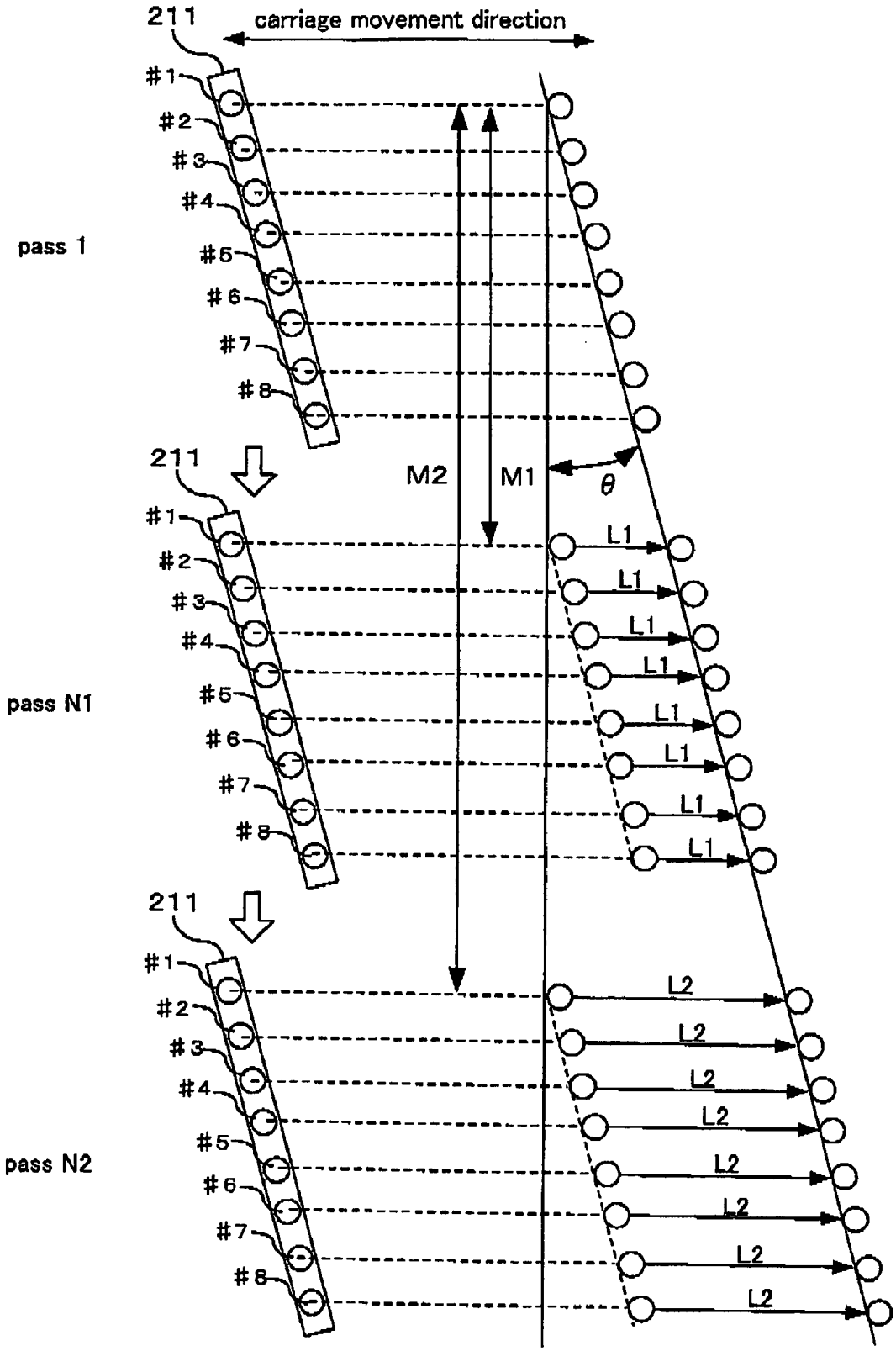
FIG. 21 is an explanatory diagram illustrating an amount of change in the timing at which ink is ejected.

FIG. 21 illustrates the relationship between the carry amount of the medium S, the inclination of actually formed dots, and the amount of change in the timing for ejecting ink from the nozzles #1 to #180. Assuming that the carry amount of the medium S is "M", the inclination of formed dots is "θ", and the amount of change in the ink ejection timing is "L", then the amount L of change in the ink ejection timing can be calculated based on Equation (1) below.

$$L = M \times \tan\theta \quad (1)$$

When the carry amount of the medium S between the first pass ("pass 1") and the N1-th pass ("pass N1") is taken as "M1", the amount L1 of change in the ink ejection timing in the N1-th pass ("pass N1") can be calculated based on Equation (2) below.

$$L1 = M1 \times \tan\theta \quad (2)$$

Furthermore, the amount L2 of change in the ink ejection timing in the N2-th pass ("pass N2") after the N1-th pass ("pass N1") can be calculated based on Equation (3) below.

$$L2 = M2 \times \tan\theta \quad (3)$$

Herein, the carry amount "M" (M1, M2) of the medium S sequentially increases as the passes are performed, that is, as the printing process proceeds. Accordingly, the amount "L" of change in the ink ejection timing gradually increases in a similar manner.

It should be noted that the amount "L" (L1, L2) of change in the ink ejection timing calculated here refers to distance. When actually changing the ink ejection timing, an appropriate ink ejection timing is determined based on the amount "L" of change calculated here, and then ink is ejected.

Method for Changing Ejection Timing

The timing for ejecting ink from the nozzles #1 to #180 is changed by changing the output timing of PTS signals from the controller 126 to the head drive section 132.

Figure 22:
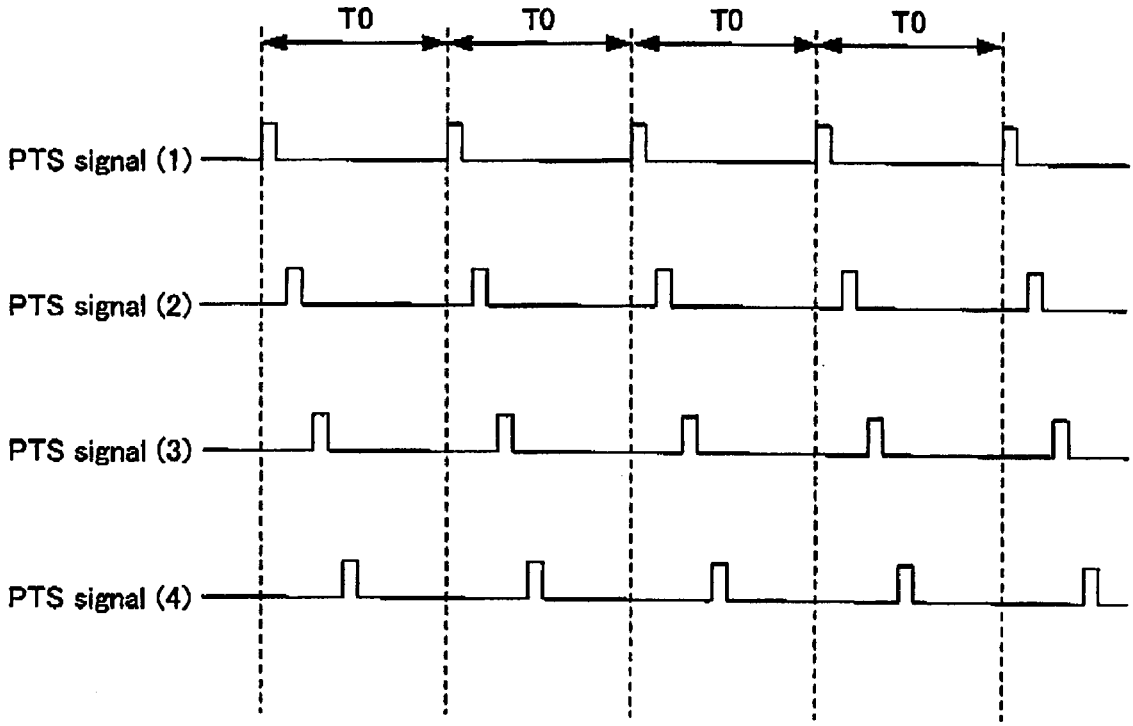
FIG. 22 is a diagram for describing an example of PTS signals.

FIG. 22 shows an example of PTS signals that are output from the controller 126. An example is described here in which dots are formed in four passes ("pass 1" to "pass 4"). A PTS signal (1) is output in the first pass ("pass 1"), and a PTS signal (2) is output in the second pass ("pass 2"). Furthermore, a PTS signal (3) is output in the third pass ("pass 3"), and a PTS signal (4) is output in the fourth pass ("pass 4").

As shown in FIG. 22, the timings at which pulses are generated are gradually shifted among the PTS signals (1) to (4). The reason for this is that every time a pass is performed, the medium S is carried and the carry amount gradually increases. In other words, it is necessary to increase the amount of change in the ink ejection timing in order to form dots in an alignment, as the carry amount of the medium S increases. Here, the timings at which pulses for the PTS signals (1) to (4) are generated are set to be gradually delayed every time a pass is performed.

Process of Controller

Every time a carrying operation on the medium S is performed, the controller 126 changes the output timing of PTS signals from the controller 126 to the head drive section 132 in accordance with the carry amount in the carrying operation. In this way, the timing for ejecting ink from the nozzles #1 to #180 of the nozzle rows 211C, 211M, 211Y, and 211K is changed. Herein, a method by which the controller 126 obtains the amount of change in the output timing of PTS signals is described.

<Method based on Calculation>

First, one method is to find the amount of change in the output timing of PTS signals based on a calculation. An example of the method is described. The controller 126 is provided with a calculating section for obtaining the amount of change in the output timing of PTS signals based on a calculation. The controller 126 has data necessary for obtaining the amount of change in the output timing of PTS signals in accordance with the carry amount of the medium S stored in the main memory 127 etc. The controller 126 reads out the data from the main memory 127 etc. when obtaining the amount of change in the output timing of PTS signals, and calculates the amount of change in the output timing of PTS signals based on the read out data and the carry amount of the medium S. The carry amount of the medium S is obtained from the rotary encoder 134. Furthermore, the data necessary for obtaining the amount of change in the output timing of PTS signals, which is stored in the main memory 127 etc., refers to various types of correction data (corresponding to "predetermined correction information") necessary for obtaining the amount of change in the output timing of PTS signals, such as "θ" and "tan θ" indicating the inclination angle of formed dots, which was described with reference to FIG. 22. The amount of change in the output timing of PTS signals is calculated by the controller 126 based on Equation (1) described above, for example.

<Method Based on Table>

In this section, a method is described in which the amount of change for one pass is stored, in advance as a table in the main memory 127 etc., in correspondence with the carry amount per pass for each print mode and resolution of an image to be printed, for example.

FIG. 23 shows an example of a table to be stored herein. As shown in FIG. 23, in the table, the amount of change in the output timing of PTS signals is stored in advance in the main memory 127 in correspondence with the resolution of an image to be printed and the print mode, for example. In other words, since the carry amount of the medium S for one pass varies depending on, for example, the resolution of an image to be printed and the print mode, the amount of change in the output timing of PTS signals is stored in advance for each resolution of an image to be printed and each print mode.

In the inkjet printer 1 according to this embodiment, five values of α1 to α5 are stored as the amount of change in the output timing of PTS signals in correspondence with the resolution of an image to be printed and the print mode. It should be noted that values are not limited to these five values of α1 to α5 when the number of types of the resolution of an image to be printed or types of the print mode is smaller or larger than the above. In other words, the values stored in the main memory 127 etc. as the amount of change in the output timing of PTS signals are set as appropriate in accordance with types of the resolution of an image to be printed or types of the print mode.

When a pass is performed, the controller 126 reads out data in the table from the main memory 127 etc., and sequentially changes the output timing of PTS signals based on the read out data.

Processing Procedure of Controller

Figure 24:
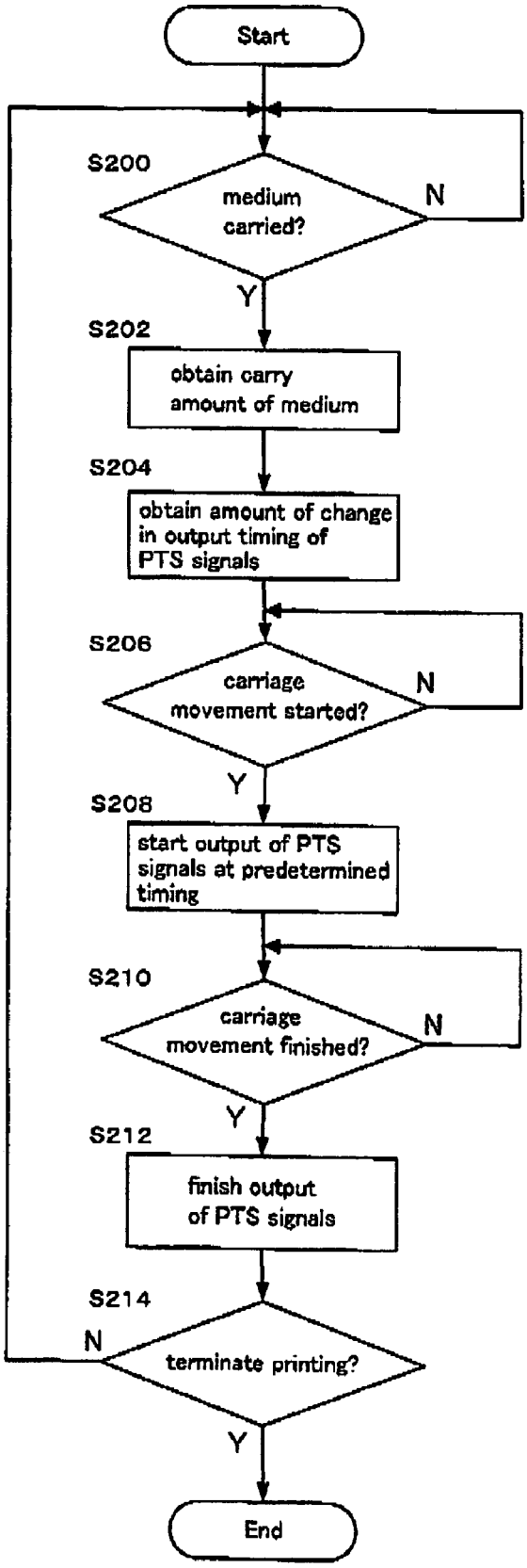
FIG. 24 is a flowchart illustrating an example of a processing procedure of a controller.

FIG. 24 is a flowchart showing an example of the processing procedure of the controller 126 at that time.

When a printing process is started, the controller 126 first checks whether or not the medium S is carried (S200). It should be noted that this check may be performed either before the medium S is carried or after the medium S is carried. If it becomes clear that the medium S is not carried based on this check, then the controller 126 continuously performs the check until the medium S is carried. On the other hand, when it becomes clear that the medium S is carried, then the controller 126 proceeds to step S202, where the carry amount of the medium S is obtained. The carry amount obtained herein may be the carry amount during a single carrying operation or may be the total carry amount from the start of printing up to that time point.

After the carry amount of the medium S is obtained in this manner, the controller 126 obtains the amount of change in the output timing of PTS signals based on the obtained carry amount of the medium S (S204). Herein, the controller 126 may obtain the amount of change in the output timing of PTS signals through calculation based on the obtained carry amount and various types of correction information such as information relating to the inclination angle of formed dots ("θ" and "tan θ", for example). Instead, the controller 126 may, based on the obtained carry amount, read out and obtain the amount of change in the output timing of PTS signals corresponding to that carry amount, for example, from the table stored in the main memory 127 etc.

After the amount of change in the output timing of PTS signals is obtained in this manner, the controller 126 next proceeds to step S206, where it is checked whether or not the movement of the carriage 41 has been started. If the movement of the carriage 41 has not been started, then controller 126 continuously performs the check until the movement of the carriage 41 is started. On the other hand, if the movement of the carriage 41 has been started, then the controller 41 proceeds to step S208, where output of PTS signals is started at a predetermined timing that has been changed based on the obtained amount of change.

Subsequently, the controller 126 proceeds to step S210, where it is checked whether or not the movement of the carriage 41 has been finished. If the movement of the carriage 41 has not been finished, then the controller 126 continuously performs the check until the movement of the carriage 41 is finished. On the other hand, if the movement of the carriage 41 has been started, then the controller 126 proceeds to step S212, where output of PTS signals is finished.

Subsequently, the controller 126 proceeds to step S214, where it is checked whether or not printing is finished. If printing is finished, then the controller 126 ends the process without performing any more process. On the other hand, if printing is not finished, then the controller 126 returns to step S200, where it is checked whether or not the medium S is carried. The controller 126 repeatedly performs such a process until printing is finished.

Detection Pattern

In the inkjet printer 1 according to this embodiment, it is possible to detect the extent of the angle of dots, which are formed on the medium S with ink ejected from the nozzles #1 to #180. This detection is performed by forming a detection pattern on the medium S with the inkjet printer 1.

Figure 25:
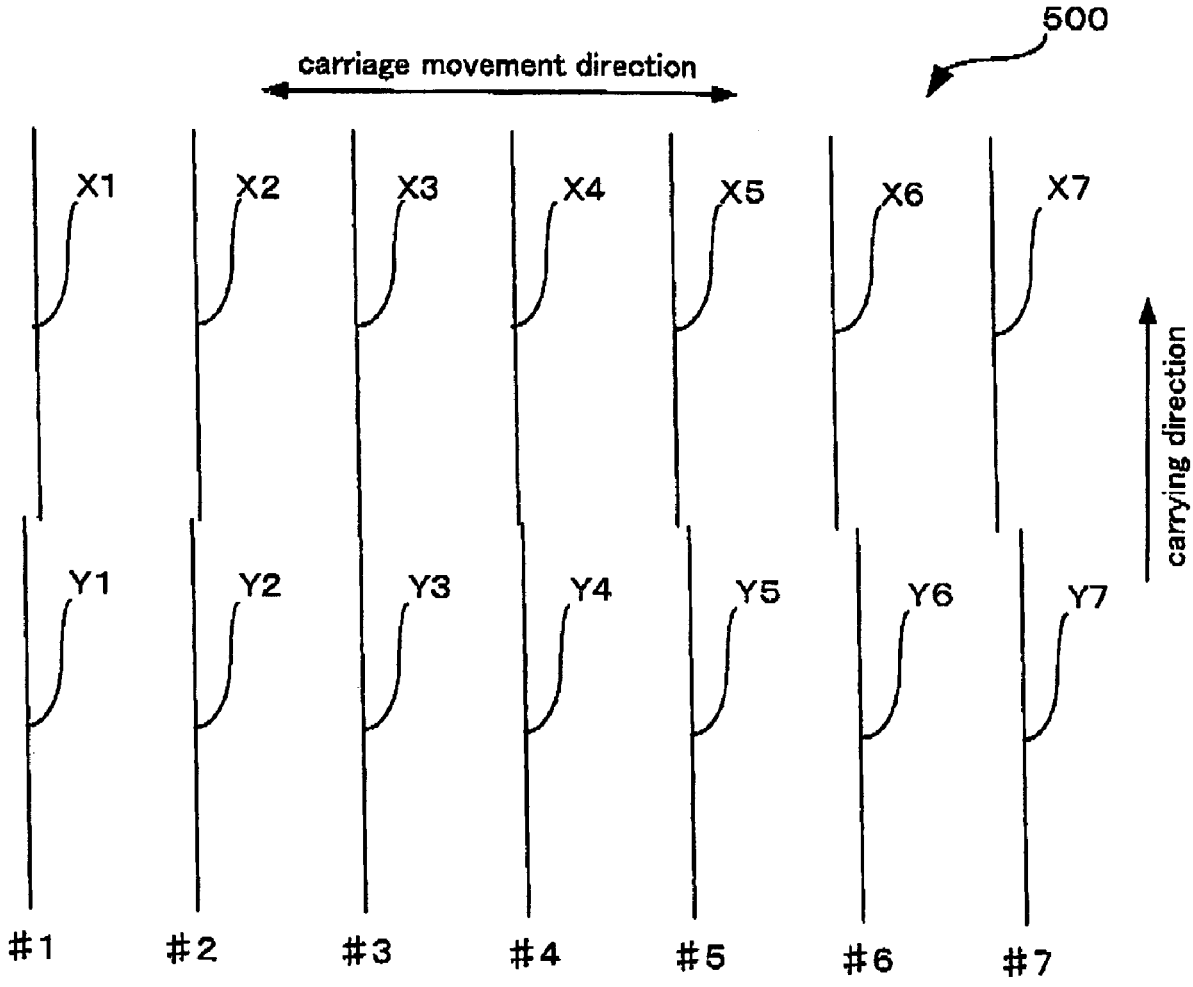
FIG. 25 is a diagram showing an example of a detection pattern.

FIG. 25 shows an example of a detection pattern 500 formed herein. The detection pattern 500 has reference patterns X1 to X7 and comparison patterns Y1 to Y7. The reference patterns X1 to X7 are respectively constituted by dot rows formed with ink ejected from the nozzles #1 to #180 based on PTS signals that are each output at a predetermined timing serving as a reference. On the other hand, the comparison patterns Y1 to Y7 are constituted by dot rows formed with ink ejected from the nozzles #1 to #180 based on PTS signals with different output timings.

Figure 26:
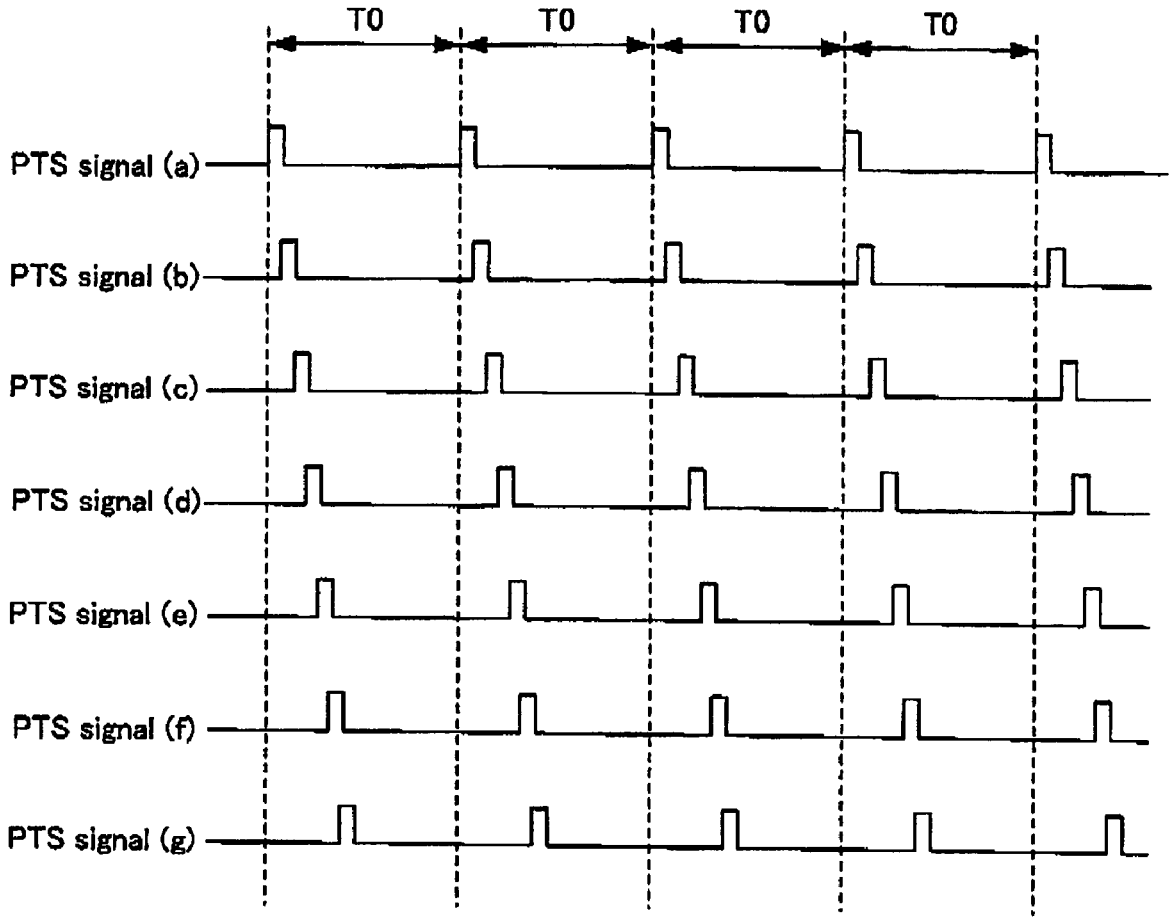
FIG. 26 is a diagram of PTS signals for forming the detection pattern.

FIG. 26 shows an example of seven types of PTS signals (a) to (g) with different output timings, which are output for forming the comparison patterns Y1 to Y7. The comparison patterns Y1 to Y7 are formed with ink ejected from the nozzles #1 to #180 based on the PTS signals (a) to (g) in which the timings for generating pulses differ from one another.

In order to detect an extent of the angle of dots formed on a medium with ink ejected from the nozzles #1 to #180, the pattern that exactly matches the reference pattern X1 to X7 without misalignment is selected from among the comparison patterns Y1 to Y7. More specifically, the comparison pattern Y1 to Y7 that exactly matches the reference pattern X1 to X7 without misalignment and thus forms one straight line therewith is selected. In this embodiment, since the comparison pattern Y3 exactly matches the reference pattern X3 without misalignment, the comparison pattern Y3 is selected.

Codes "#1" to "#7" are indicated respectively corresponding to the comparison patterns Y1 to Y7, in the vicinity of the comparison patterns Y1 to Y7 (below the comparison patterns Y1 to Y7, in this embodiment). Herein, since the comparison pattern Y3 is selected, the code "#3" corresponding to the comparison pattern Y3 is selected. By inputting this code "#3", to the inkjet printer 1, a correction is possible even in a case where dots are formed at an angle on the mediums due, for example, to the head 21 being installed at an angle with respect to the movement direction of the carriage 41. In the inkjet printer 1 according to this embodiment, when such correction information is input, the correction information is stored in the main memory 127 etc. and the correction information is read out from the main memory 127 etc. to be reflected on the printing process when printing is being carried out.

It should be noted that the adjustment pattern 500 may be formed during a manufacturing stage of the inkjet printer 1 in a factory or the like, or may be formed as appropriate by a user or a maintenance worker.

Overview

In the inkjet printer 1 according to this embodiment, every time a carrying operation is performed, the controller 126 changes the output timing of PTS signals in accordance with the carry amount in the carrying operation, so that it is possible to adjust the positions of dots formed with ink ejected from the nozzles #1 to #180 of the nozzle rows 211C, 211M, 211Y, and 211K. Accordingly, it is possible to adjust the positions at which dots are formed, every time a carrying operation is performed, even in a case where, for example, the head 21 is installed at an angle with respect to the movement direction of the carriage 41 and thus dots are formed at an angle on the medium S. Thus, it is possible to prevent the quality of an image to be printed from being significantly damaged. As a result, it is possible to improve the image quality of a print image even in a case as described above.

It is possible to suppress the image quality of a print image from being degraded even in a case where, for example, the head 21 is installed at an angle with respect to the movement direction of the carriage 41 and thus dots are formed at an angle on the medium S, especially when the nozzles #1 to #180 of the nozzle rows are arranged in a predetermined direction.

Furthermore, by providing a calculating section for calculating the amount of change when changing the output timing of PTS signals, it is possible to easily obtain the amount of change. Furthermore, by providing a table in which the carry amount of the medium S is associated with the amount of change in the output timing of PTS signals, it is possible to easily obtain the amount of change.

Furthermore, since it is possible to form the detection pattern 500 for detecting an extent of the angle of dots formed with ink ejected from the nozzles #1 to #180 on the medium S, it is possible to easily detect an appropriate amount of change in the output timing of PTS signals.

Configuration of Printing Systems and Others

Figure 27:
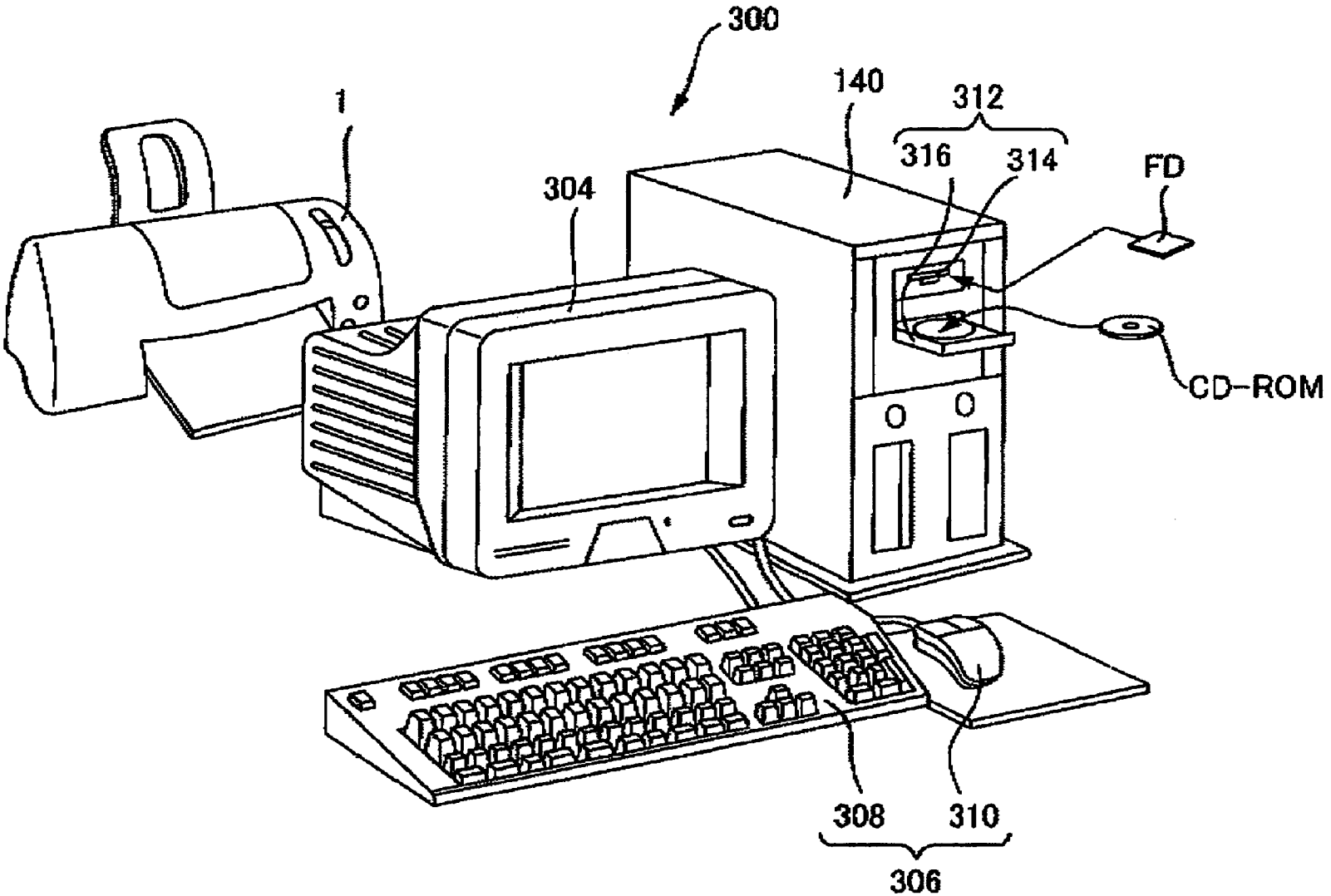
FIG. 27 is a perspective view showing the appearance of an example of a printing system.

The following is a description concerning an example in which the inkjet printer 1 is provided as a printing apparatus, as a printing system according to an embodiment of the present invention. FIG. 27 shows the appearance configuration of a printing system according to an embodiment of the present invention. A printing system 300 is provided with the computer 140, a display device 304, and an input device 306. The computer 140 is achieved by various computers such as a personal computer.

The computer 140 is provide with a reading device 312 such as an FD drive 314 and a CD-ROM drive 316. In addition to the above, the computer 140 may be provided with, for example, an MO (magnet optical) disk drive and a DVD drive. Furthermore, the display device 304 is achieved by various display devices such as a CRT display, a plasma display, a liquid crystal display. The input device 306 is achieved by, for example, a key board 308 and a mouse 310.

Figure 28:
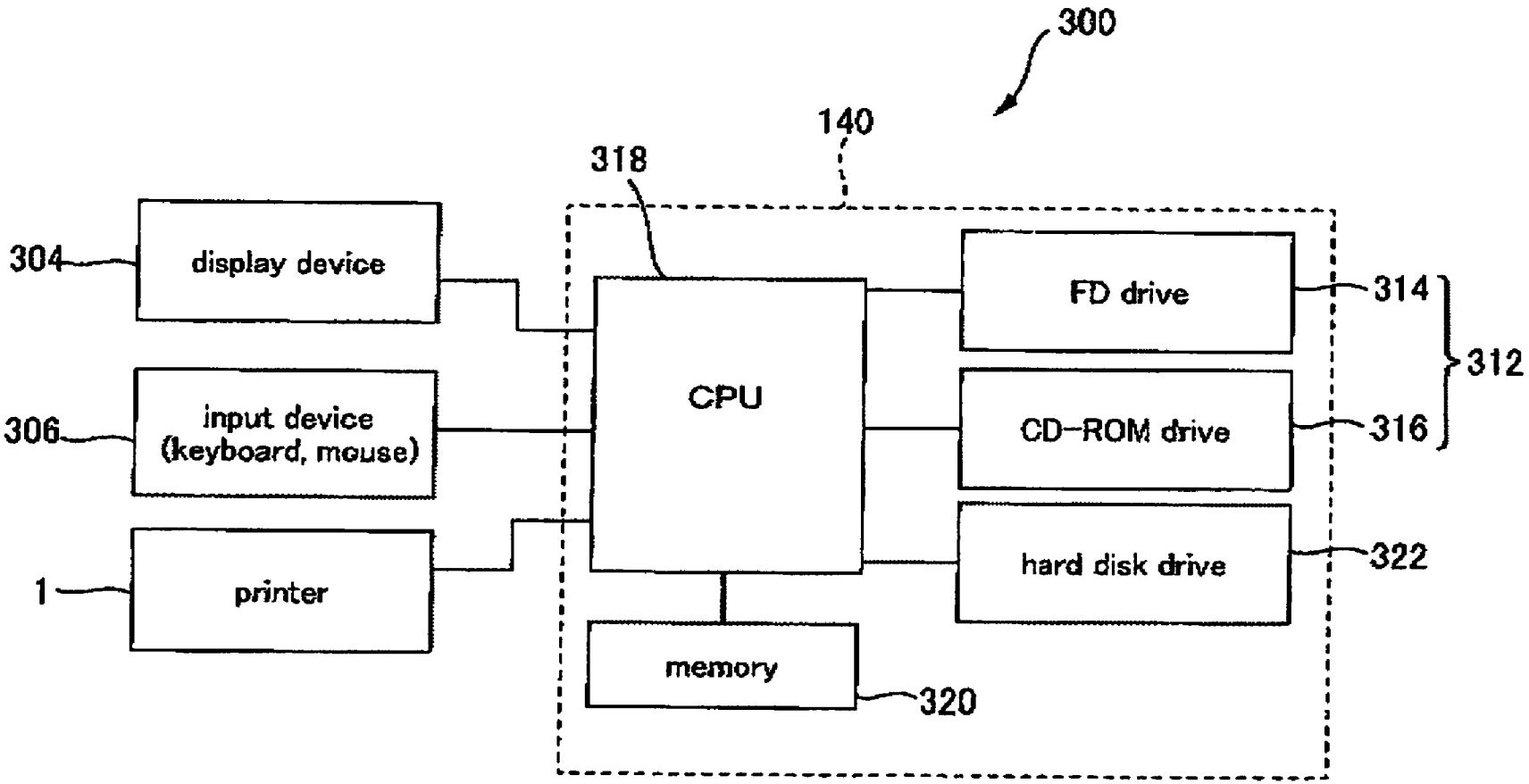
FIG. 28 is a block diagram showing the system configuration of an example of the printing system.

FIG. 28 is a block diagram showing an example of the system configuration of the printing system according to this embodiment. The computer 140 is provided with a CPU 318, a memory 320, and a hard disk drive 322 in addition to the reading device 312 such as the FD drive 314 and the CD-ROM drive 316.

The CPU 318 performs overall control of the computer 140. Furthermore, various types of data is stored in the memory 320. A printer driver, for example, as a program for controlling a printing apparatus such as the inkjet printer 1 according to this embodiment is installed in the hard disk drive 322. The CPU 318 reads out a program such as the printer driver stored in the hard disk drive 322 and operates according to the program. Furthermore, the CPU 318 is connected to, for example, the display device 304, the input device 306, and the inkjet printer 1 arranged outside the computer 140.

As an overall system, the printing system 300 that is thus achieved is superior to conventional systems.

Other Embodiments

In the foregoing embodiment, a printing apparatus, such as a printer, according to the present invention was described. However, the foregoing embodiment is for the purpose of facilitating the understanding of the present invention and is not to be interpreted as limiting the present invention. The invention can of course be altered and improved without departing from the gist thereof and includes equivalents. In particular, the embodiments noted below are also included in the printing apparatus according to the present invention.

<Regarding the Carry Mechanism>

In the foregoing embodiment, a configuration including the paper carry motor 15, the carry roller 17A and the paper discharge roller 17B, for example, was disclosed as the "carry mechanism", but the "carry mechanism" is not limited to such a mechanism, and as long as it is a mechanism that can carry the medium S, any mechanism is suitable.

<Regarding the Nozzles>

In the foregoing embodiment, the nozzles are arranged in a straight line in a predetermined direction, but the "nozzles" do not necessarily have to be arranged in a straight line in this manner, and as long as the "nozzles" are arranged in a predetermined direction, they do not have to be arranged in a straight line, and they may form a staggered layout, for example.

<Regarding the Ink Ejection Mechanism>

In the foregoing embodiment, a mechanism of ejecting ink using piezo elements was explained as the piezoelectric devices, but the mechanism of ejecting ink is not limited to a mechanism for ejecting ink by this method, and as long as it is a mechanism of ejecting ink, any method may be employed, such as ejecting ink by generating bubbles in the nozzles through heat or the like.

<Regarding the Moving-and-ejecting operation>

In the foregoing embodiment, the "moving-and-ejecting operation" was described as a so-called pass, or in other words, as an operation of ejecting ink onto the medium S while the carriage 41 moves once in the carriage movement direction, but the "moving-and-ejecting operation" is not necessarily limited to such an operation in which the carriage moves in a single carry in this manner. More specifically, a series of operations, for example, operations in which the carriage 41 moves in the carriage movement direction, is then stopped, and starts moving again, or operations in which the carriage 41 moves back and forth, may also be referred to as the moving-and-ejecting operation. In other words, any moving-and-ejecting operation performed during an interim of a carrying operation on a medium is included in the "moving-and-ejecting operation".

<Regarding the Signal Outputting Section>

In the foregoing embodiment, the controller 126 was described as an example of the signal outputting section for outputting signals (such as PTS signals), but the signal outputting section is not limited to such a controller 126 for performing overall control of the printing apparatus, and it may be additionally provided with a dedicated circuit for outputting signals (such as PTS signals), or the head drive section 132, for example, may be provided with a signal outputting section for outputting signals (such as PTS signals).

<Regarding the Signal>

In the foregoing embodiment, a PTS signal was explained as an example of the "signal serving as a reference for causing the ink to be ejected at a same timing from the plurality of nozzles", but the signal is not limited to such a PTS signal, and as long as it is a "signal serving as a reference for causing the ink to be ejected at a same timing from a plurality of nozzles", a signal in any form is suitable.

<Regarding the Print Mode>

In the foregoing embodiment, the interlaced mode and the overlap mode were explained as the "print mode", but the "print mode" is not limited to these print modes, and the "print model" includes print modes other than these, that is, band printing and draft printing.

<Regarding the Predetermined Correction Information>

In the foregoing embodiment, "θ" and "tan θ", for example, indicating the inclination angle of formed dots were explained as the "predetermined correction information", but the "predetermined correction information" is not limited to such correction information, and the "predetermined correction information" may be the amount of change in the output timing of PTS signals in a specific carry amount or may be the ratio between the carry amount and the amount of change. In short, the "predetermined correction information" includes any information, except for the carry amount of the medium S, necessary for obtaining the amount of change in the output timings of PTS signals.

<Regarding the Detection Pattern>

In the foregoing embodiment, a pattern having reference patterns X1 to X7 and comparison patterns Y1 to Y7 was explained as an example of the detection pattern, but the detection pattern is not limited to such a pattern, and as long as it is a pattern formed on the medium S in order to detect an appropriate amount of change in the output timing of PTS signals, for example, any pattern is included in the detection pattern of the present invention.

<Regarding the Ink>

The ink that is used may be pigment ink or may be other various types of ink such as dye ink.

As for the color of the ink, it is also possible to use ink of other colors, such as light cyan (LC), light magenta (LM), dark yellow (DY), or red, violet, blue or green, in addition to the above-mentioned yellow (Y), magenta (M), cyan (C) and black (K).

<Regarding the Dots>

In the foregoing embodiment, substantially circular dots were formed, but the dots may be formed as elliptical dots or as dots of other shapes. In other words, as long as they constitute pixels of an image to be printed, the dots may have any shape or form.

<Regarding the Printing Apparatus>

In the foregoing embodiment, the above-described inkjet printer 1 was described as an example of the printing apparatus according to the present invention, but the present invention is not limited to such a printing apparatus, and an inkjet printer for ejecting ink using other techniques also may be employed.

<Regarding the Medium>

The medium S may be any of plain paper, matte paper, cut paper, glossy paper, roll paper, print paper, photo paper, and roll-type photo paper or the like. In addition to these, the medium S maybe a film material such as OHP film and glossy film, a cloth material, or a metal plate material or the like. In other words, any medium that can be printed on can be used.

What is claimed is:

1. A printing method comprising:

performing a carrying operation for carrying a medium;

performing, during an interim of the carrying operation, a moving-and-ejecting operation for ejecting ink at a same timing from a plurality of nozzles onto the medium while moving the nozzles relative to the medium; and changing, every time the carrying operation is performed, the timing at which the ink is ejected from the plurality of nozzles in accordance with a carry amount of the carrying operation that has actually been performed, wherein positions of dots formed on the medium with the ink ejected from the plurality of nozzles are gradually shifted in one direction every time the carrying operation is performed, and wherein an amount of shifting of the positions of the dots, which are formed on the medium with the ink ejected from the plurality of nozzles, varies in accordance with the carry amount of the carrying operation that has been performed.

2. A printing method according to claim 1, wherein the plurality of nozzles are arranged in a predetermined direction.

3. A printing method according to claim 2, wherein the predetermined direction in which the plurality of nozzles are arranged intersects with a direction in which the medium is carried.

4. A printing method according to claim 1, wherein the carry amount of the carrying operation varies in accordance with a print mode.

5. A printing method according to claim 1, wherein the carry amount of the carrying operation varies in accordance with a resolution of an image to be printed.

6. A printing method according to claim 1, wherein an amount of change in the timing is calculated by a calculating section.

7. A printing method according to claim 1, wherein an amount of change in the timing is calculated based on the carry amount of the carrying operation that has been performed and predetermined correction information.

8. A printing method according to claim 1, wherein the timing is changed according to a table in which the carry amount of the carrying operation that is performed is associated with an amount of change in the timing.

9. A printing method according to claim 1, further comprising:

a step of printing a detection pattern for detecting an appropriate amount of change in the timing.

10. A printing apparatus comprising:

a carry mechanism capable of performing a carrying operation of carrying a medium with at least two different carry amounts;

a plurality of nozzles that perform a moving-and-ejecting operation of ejecting ink onto the medium while moving relative to the medium during an interim of the carrying operation;

a signal outputting section that outputs a signal serving as a reference for causing the ink to be ejected at a same timing from the plurality of nozzles; and a controller that changes a timing at which the signal is output from the signal outputting section, every time the carrying operation is performed, in accordance with a carry amount of the carrying operation that has actually been performed, wherein positions of dots formed on the medium with the ink ejected from the plurality of nozzles are gradually shifted in one direction every time the carrying operation is performed by the carry mechanism, and wherein an amount of shifting of the positions of the dots, which are formed on the medium with the ink ejected from the plurality of nozzles, varies in accordance with the carry amount of the carrying operation that has been performed by the carry mechanism.

11. A computer-readable medium for causing a printing apparatus to operate, comprising:

a code for performing a carrying operation of carrying a medium with a carry mechanism;

a code for performing, during an interim of the carrying operation, a moving-and-ejecting operation of ejecting ink at a same timing from a plurality of nozzles onto the medium while moving the nozzles relative to the medium; and a code for changing, every time the carrying operation is performed, the timing at which the ink is ejected from the plurality of nozzles in accordance with a carry amount of the carrying operation that has actually been performed, wherein positions of dots formed on the medium with the in ejected from the plurality of nozzles are gradually shifted in one direction every time the carrying operation is performed, and wherein an amount of shifting of the positions of the dots, which are formed on the medium with the ink ejected from the plurality of nozzles, varies in accordance with the carry amount of the carrying operation that has been performed.

* * * * *